US005310060A

United States Patent [19]

Bitner et al.

[11] Patent Number: 5,310,060

[45] Date of Patent: May 10, 1994

[54] TAMPER-EVIDENT, CHILD-RESISTANT BLISTER PACKAGES FOR MEDICAMENTS AND NON-MEDICAMENTS

[75] Inventors: John M. Bitner, Naperville; Craig T. Vanderburg, Buffalo Grove; Curtis E. Hart, North Chicago, all of Ill.

[73] Assignee: G. D. Searle & Co., Chicago, Ill.

[21] Appl. No.: 960,067

[22] Filed: Oct. 13, 1992

[51] Int. Cl.[5] ..... B65D 83/04

[52] U.S. Cl. ..... 206/532; 206/469; 206/538; 206/807

[58] Field of Search ..... 206/538, 539, 461, 469, 206/484, 462, 532, 807

[56] References Cited

U.S. PATENT DOCUMENTS

| | | | |
|---|---|---|---|
| 29,705 | 7/1978 | Compere . | |
| 3,129,817 | 4/1964 | Rohdin | 206/462 |
| 3,503,493 | 3/1970 | Nagy | 206/232 |
| 3,809,221 | 5/1974 | Compere . | |
| 3,835,995 | 9/1974 | Haines . | |
| 3,899,080 | 8/1975 | Brunda . | |
| 3,905,479 | 9/1975 | Gerner et al. . | |
| 3,912,081 | 10/1975 | Haines et al. . | |
| 3,912,082 | 10/1975 | Gerner et al. . | |
| 3,921,805 | 11/1975 | Compere . | |
| 3,924,746 | 12/1975 | Haines . | |
| 3,924,747 | 12/1975 | Gerner . | |
| 3,933,245 | 1/1976 | Mullen | 206/538 X |
| 3,941,248 | 3/1976 | Moser et al. . | |
| 4,011,949 | 3/1977 | Braber et al. . | |
| 4,169,531 | 10/1979 | Wood . | |
| 4,537,312 | 8/1985 | Intini . | |
| 4,988,004 | 1/1991 | Intini . | |
| 5,046,618 | 9/1991 | Wood | 206/532 |
| 5,088,603 | 2/1992 | Kirkpatrick | 206/484 X |

FOREIGN PATENT DOCUMENTS

| | | |
|---|---|---|
| 2360922 | 6/1974 | Fed. Rep. of Germany . |
| 2834848 | 2/1980 | Fed. Rep. of Germany . |
| 1450905 | 9/1976 | United Kingdom . |

*Primary Examiner*—Bryon P. Gehman

*Attorney, Agent, or Firm*—Roberta L. Hastreiter; Roger A. Williams

[57] ABSTRACT

The present invention concerns a novel tamper-evident, child-resistant blister package for medicaments and nonmedicaments which is user-friendly, but which is difficult to open by young children and impaired adults.

Because the blister package has pull tabs which are designed to be pulled away from, rather than towards, article-receiving pockets which may be present in the blister package other than the article-receiving pocket being accessed, a young child or user of the blister package can only access one article-receiving pocket at a time, whether deliberately or inadvertently.

The blister package of the invention is an attractive and inexpensive package for the merchandising of pharmaceutical and other products which is constructed in a manner which facilitates mass production.

29 Claims, 2 Drawing Sheets

Fig. 1
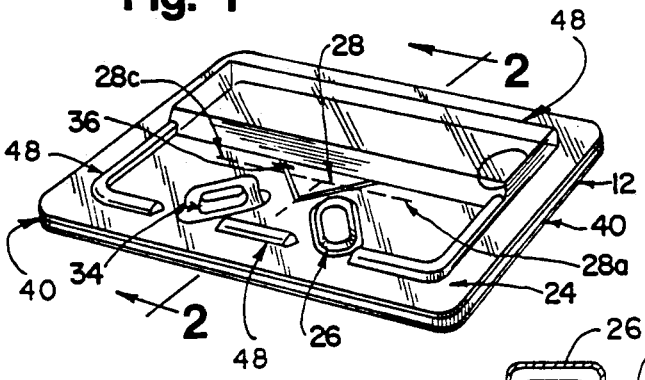
Fig. 5
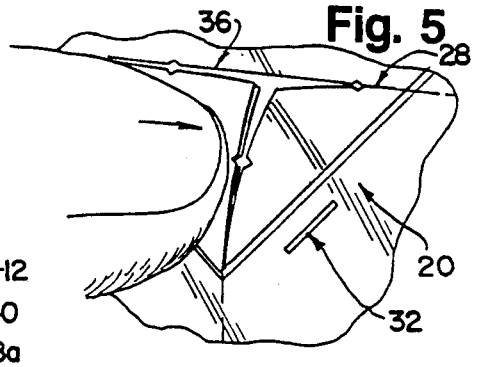
Fig. 2
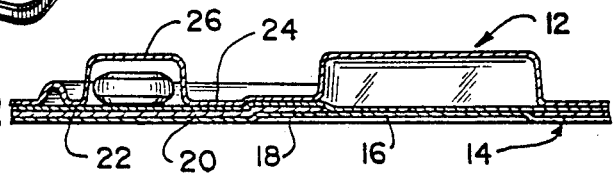
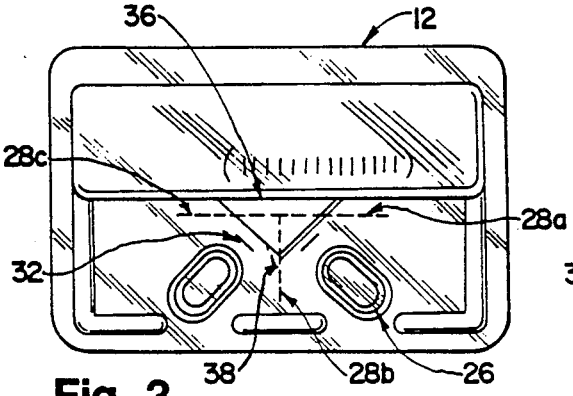
Fig. 3
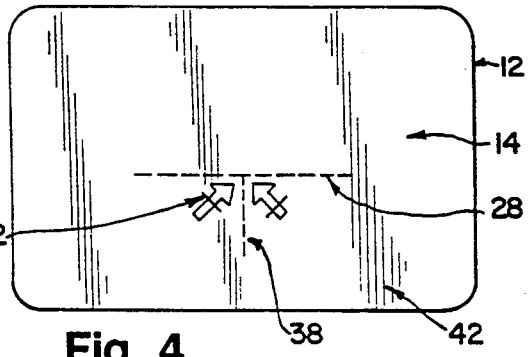
Fig. 4
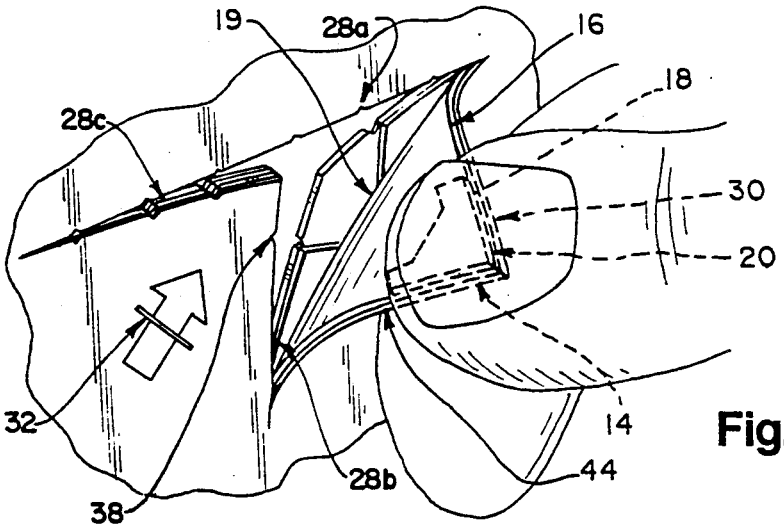
Fig. 6

TAMPER-EVIDENT, CHILD-RESISTANT BLISTER PACKAGES FOR MEDICAMENTS AND NON-MEDICAMENTS

BACKGROUND OF THE INVENTION

The present invention generally relates to novel tamper-evident, child-resistant blister packages for medicaments and non-medicaments.

It is desirable for manufacturers of products to provide tamper-evident packaging for their products which will provide a clear indication when the packaging has been subject to tampering, and which is highly resistant to opening by children, but which, at the same time, is sufficiently easy for the average unimpaired consumer to open.

One of the problems facing parents today is their responsibility of keeping medications and other dangerous and/or small articles beyond the reach of their young children. Young children do not have the ability to recognize the risk involved in consuming prescribed or over-the-counter medication and other dangerous and/or small articles. Because of this fact, there is an important need for a package from which these items are readily accessible to an unimpaired adult, but are not accessible to a young child or impaired adult.

In past years, a trend in the packaging of medication and other dangerous and/or small articles has been to provide packages which will be safe, even if found by young children. Most developments in the "childproofing" line have been directed to the improvement in pill bottles. In this regard, safety caps have been devised which require a certain series of pushes and turns in order to open the bottle. However, there has been less development in the area of "childproofed," press-type blister packages with which this invention is concerned.

Blister packaging has become popular in recent years, not only for medicaments in capsule, lozenge or pill form, but also for small automotive parts, household articles, and miscellaneous hardware.

Blister packages are generally made up of a first sheet, typically a clear, preformed polyvinyl chloride or polystyrene with flexible bubbles which form separate compartments for one or more pills, and a second, rupturable sheet material, such as an aluminum foil or paper sheet, which has been attached to the first sheet. The second sheet is attached to the first sheet by heat-sealing, solvent welding, gluing, or otherwise. The article contained in the package may be removed from the blister compartment by pressing on the flexible blister which, in turn, forces the tablet against the second sheet, rupturing the second sheet, and ejecting the article.

Because the contents of blister packages are generally visible, and are often brightly colored, young children are attracted to the contents of these packages, with a substantial risk of injury and/or death if they succeed in opening such packages and ingesting their contents. Accordingly, it is important to "childproof" such packages by rendering these packages too difficult to open for children too young to realize the potential hazard in doing so but, at the same time, user friendly for adult users of the various articles contained in the packages.

The tamper-evident, child-resistant blister packages of the invention for medicaments and non-medicaments are structurally different from child-resistant packaging described in the art.

SUMMARY OF THE INVENTION

The present invention provides a tamper-evident, child-resistant blister package for medicaments and nonmedicaments comprising: (a) a top layer; (b) a nonrupturable film layer attached to the inner surface of the top layer, and to a rupturable film layer; (c) a rupturable film layer attached to that side of the nonrupturable film layer which is not attached to the top layer, and to a blister sheet; (d) a blister sheet attached to that side of the rupturable film layer which is not attached to the nonrupturable film layer, the blister sheet containing at least one article-receiving pocket; (e) a plurality of perforations located adjacent to each article-receiving pocket and extending through each of the top layer, the nonrupturable film layer, the rupturable film layer and the blister sheet; (f) at least one depression present in the blister sheet and located in the center of the plurality of perforations in which the rupturable film layer is not adhered to the blister sheet; and (g) at least one die cut located between the plurality of perforations and each of the article-receiving pockets and extending through each of the top layer, the nonrupturable film layer, the rupturable film layer and the blister sheet for selectively separating the nonrupturable film layer from the rupturable film layer and exposing the rupturable film layer extending over an article-receiving pocket when the nonrupturable film layer is directionally pulled across the article-receiving pocket.

BRIEF DESCRIPTION OF THE DRAWINGS

FIG. 1 is a perspective view of an embodiment of the blister package of the invention which contains two article-receiving pockets;

FIG. 2 is a cross-sectional view of FIG. 1 taken across Line 2—2 of FIG. 1;

FIG. 3 is a top elevational view of FIG. 1;

FIG. 4 is a bottom elevational view of FIG. 1;

FIG. 5 is a fragmentary perspective of a blister package of the invention being opened;

FIG. 6 is a fragmentary perspective of a blister package of the invention showing how the pull tabs are pealed in order to pull the nonrupturable film layer away from the rupturable film layer, and over an article-receiving pocket in a direction away from other article-receiving pockets;

Figure 7:
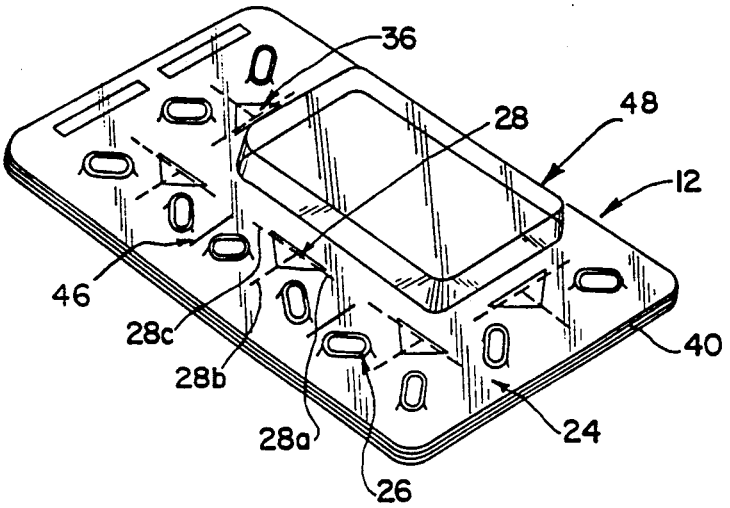
FIG. 7 is a perspective view of an embodiment of the blister package of the invention which contains ten article-receiving pockets.

DETAILED DESCRIPTION OF THE INVENTION (1) Description of Invention

The present invention relates to a novel tamper-evident, child-resistant blister package for medicaments and nonmedicaments which is user-friendly to patients and other users of the package, but which, as documented by the studies presented hereinbelow, is extremely difficult to open by young children, and in which the manufacturing costs are reduced. It is an attractive and inexpensive package for the merchandising of pharmaceutical and other products which is constructed in a manner which facilitates mass production.

The blister packages of the invention may contain from one to a multiplicity of articles, such as medicaments in the form of capsules, tablets, lozenges, pills and/or the like, or nonmedicaments, such as poisons, catalysts, cleaning compositions, batteries, nuts, bolts, hooks and/or other small hardware.

The blister packages of the invention may be of any convenient size, and of any convenient shape, such as square, rectangular, triangular, round, or oval. The size of the blister package of the invention will vary, depending upon the number of article-receiving pockets which are contained therein. Preferably, the blister package of the invention will be of a size ranging from about 12 inches×12 inches to about 1 inch×1 inch, and more preferably about 3 inches×2 inches.

The blister packages of the invention may contain any desired number of article receiving pockets, but preferably contain from about 1 to about 100 article receiving pockets, most preferably from about 2 to about 20 article receiving pockets.

Specific blister packages within the scope of the invention include, but are not limited to, the blister packages discussed in detail herein and/or illustrated in the drawings contained herein.

Contemplated equivalents of the blister packages described herein and/or illustrated in the drawings contained herein include blister packages which otherwise correspond thereto, and which have the same general properties and/or components thereof, wherein one or more simple variations of components are made.

As evidenced by the testing of the blister packages o the invention described hereinbelow under the heading "Testing," the novel tamper-evident, child-resistant blister packages described herein have been found to be in compliance with standards of the Poison Prevention Packaging Act of 1970, 15 USC §1471-1475, and with the Act's associated regulations, 16 CFR §1700.1-1700.20, which describe test procedures in which packages are given to children for a given period of time to determine the accessibility to the children of the package contents. These standards have been promulgated by the Consumer Product Safety Commission as standards which reasonably protect children from entering packaging that would contain potentially harmful substances.

"Special Packaging" is defined by the Act and its associated regulations as being packaging that is designed or constructed to be significantly difficult for children under 5 years of age to open, or to obtain a toxic or harmful amount of the substance contained therein, within a reasonable time, and not difficult for normal adults to use properly. However, it does not mean packaging which all such children cannot open, or cannot obtain a toxic or harmful amount of a substance contained therein, within a reasonable time.

The Act and regulations require that special packaging be employed to protect children from serious personal injury or illness resulting from substances such as aspirin, acetaminophen, methyl salicylate, diphenhydramine, controlled drugs, prescription drugs, iron-containing drugs, dietary supplements containing iron, oral contraceptives, sulfuric acid, turpentine, methanol, ethylene glycol, furniture polish, kindling and/or illuminating preparations and solvents for paint and other similar surface-coating materials.

According to the Act and its associated regulations, all special packaging must meet the following specifications:

(a) Child-resistant effectiveness of not less than 85 percent without a demonstration, and not less than 80 percent after a demonstration, of the proper means of opening such special packaging. In the case of unit packaging, child-resistant effectiveness of not less than 80 percent.

and (b) Adult-use effectiveness of not less than 90 percent.

Two hundred (200) healthy and normal children between the ages of forty-two (42) and fifty-one (51) months of age, evenly distributed by age and sex, are required by the Act and its associated regulations to be used to test the ability of the special packaging to resist opening by children. A test failure is defined as being any child who opens the special packaging, or who gains access to its contents. In the case of unit packaging, a test failure is defined as being any child who opens, or gains access to, the number of individual units which constitute the amount that may produce serious personal injury or serious illness, or a child who opens, or gains access to, more than eight (8) individual units, whichever number is lower, during the full ten (10) minutes of the testing.

One hundred (100) adults, ages eighteen (18) to forty-five (45) years inclusive, with no overt physical or mental handicaps, and seventy (70) percent of whom are female, must comprise the test panel for normal adults.

The end result of the blister packages of the invention is that a young child is unlikely to open the packages successfully because, in order to open the blister packages, one must have knowledge of the blister package opening procedure, rather than merely a minimum amount of strength for opening the package. A young child who is not instructed on the proper opening procedure for the blister packages of the invention will generally remain unable to reach the contents of the package. An older child who is able to reach the contents of the blister packages of the invention, on the other hand, should have sufficient understanding and discretion to avoid ingesting the contents of the package. The safety factors presented by such packaging will also tend to protect adults who are too impaired (as by age, alcohol or drugs) to cope with the task of opening the packages and, at the same time, to allow unimpaired adults to easily open the blister packages with a minimum amount of strength.

For the purpose of illustrating the blister packages of the present invention, there are shown in the drawings, which form a material part of this disclosure, two different embodiments of the blister packages which are presently preferred.

The various components of the blister packages of the invention are generally arranged in the manner shown in the drawings. However, the present invention is not limited to the precise arrangements, configurations, dimensions and instrumentalities shown in these drawings. These arrangements, configurations, dimensions and instrumentalities may be otherwise, as circumstances require.

Different specific embodiments of the blister packages of the present invention will now be described with reference to the drawings.

The drawings contained herein are provided to enable one of ordinary skill in the art to practice the present invention. These drawings are merely illustrative, however, and should not be read as limiting the scope of the invention as it is claimed in the appended claims.

Referring to the drawings, a tamper-evident, child-resistant blister package 12 of the invention for unit or multiple doses of pharmaceutical products or other articles 34 comprises: (1) a top layer 14; (2) an optional adhesive layer 16, or the like, underneath the top layer 14 which adheres a nonrupturable film layer 18 to the inner surface 44 of the top layer; (3) a nonrupturable film layer 18 which is secured to the top layer 14 in the manner described above, and to a rupturable film layer 20 by methods known by those of skill in the art, such as by pressure sensitive adhesion of an optional pressure sensitive adhesive layer 19, or the like, located between the nonrupturable film layer 18 and the rupturable film layer 20; (4) a rupturable film layer 20 located beneath the nonrupturable film layer 18; (5) an optional heat seal coating 22, or the like, located underneath the rupturable film layer 20, which secures the rupturable film layer 20 to a blister sheet 24; and (6) a blister sheet 24 which contains one or more article-receiving pockets 26.

The blister package 12 contains a plurality of perforations 28 separated by interruptions 38 which form the shape of a "T," and which are located centrally between two article-receiving pockets 26. The perforations 28 penetrate all of the layers of the blister package 12.

When the blister package 12 is penetrated to access the contents of an article-receiving pocket 26 by puncturing the perforations 28 which penetrate the blister package 12 downward towards the top layer 14, one or more manually-grippable pull tabs 30 comprising the top layer 14, the optional adhesive layer 16, the rupturable film layer 20, the optional pressure sentitive adhesive layer 19 and the nonrupturable film layer 18 is generated. Such a pull tab can be manipulated such that it extends directly away from the blister sheet 24 (see FIG. 6), and away from all article-receiving pockets 26 other than the article receiving pocket 26 that it is over, so that only the contents of one article-receiving pocket 26 can be accessed at a time. The unperforated portion of the blister package 12 stays intact.

After a pull tab 30 is generated in the manner described above, it must be manually pealed away from the blister sheet 24. The pull tab includes a portion of the nonrupturable film layer 18 and the rupturable film layer 20. When the pull tab 30 is pealed away from the blister sheet 24, it is pulled across a die cut 32.

The die cut 32 is another perforation which penetrates all of the layers of the blister package 12. The die cut 32 is located adjacent to the perforations 28 and parallel to that side of a triangular-shaped depression 36 described hereinbelow which is present in the blister sheet 24 along the path of pull for the pull tabs 30. The die cut 32 separates the nonrupturable film layer 18 from the rupturable film layer 20, which remains adhered to the blister sheet 24 as the pull tab 30 is pulled across the die cut 32. The rupturable film layer 20 remains adhered to the blister sheet 24, but the nonrupturable film layer 18 is pulled off of the rupturable film layer 20. The rupturable film layer 20 is thereby exposed to the user and can now be physically ruptured to access the medication or other article 34 contained in an article-receiving pocket 26. The article 34 can be pushed through the rupturable film layer 20 by applying pressure to the article-receiving pocket 26 downwards towards the rupturable film layer 20.

An important feature of the blister package 12 of the invention is that it is designed in a manner such that one pull tab 30 is generated for each article-receiving pocket 26, so that the nonrupturable film layer 18 may only be pulled directionally towards and across one article-receiving pocket 26 at a time, while all other article-receiving pockets 26 which may be present in the blister package 12 remain fully secured by the undisturbed nonrupturable film layer 18.

The blister sheet 24 also contains a recessed triangular-shaped depression 36 proximately located to the perforations 28 in which the rupturable film layer 20 is not adhered to the blister sheet 24. This feature of the blister packages 12 of the invention facilitates the formation of the pull tabs 30.

Figure 8:
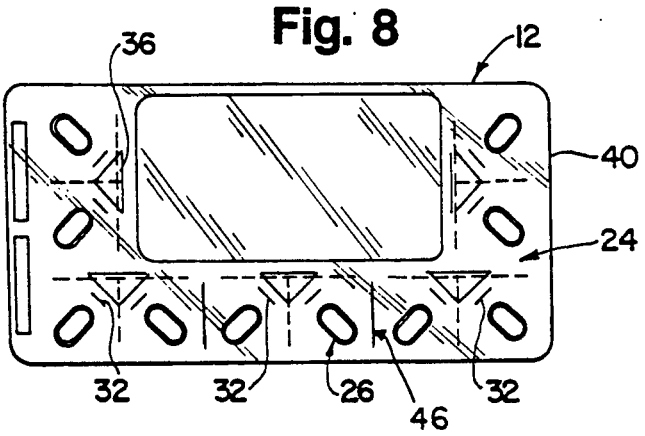
FIG. 8 is a top elevational view of FIG. 7.
Figure 9:
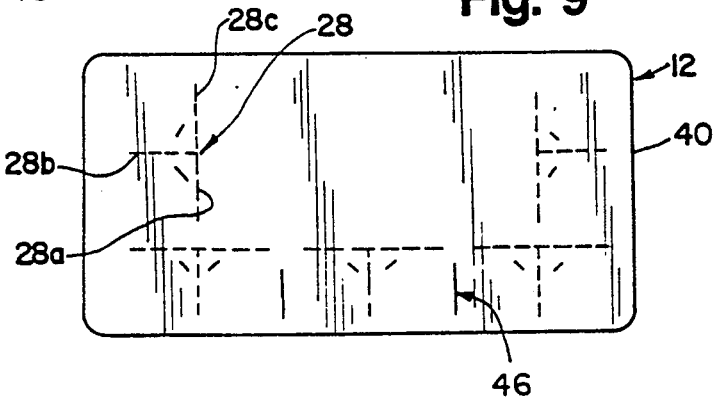
FIG. 9 is a bottom elevational view of FIG. 7.

In embodiments of the blister package 12 of the invention which have more than two article-receiving pockets 26, such as the embodiment of the invention illustrated in FIGS. 7-9, which contains 10 article-receiving pockets 26, the blister package 12 will generally have one or more nonrupturable film layer dividers 46.

The nonrupturable film layer divider 46 is a die cut slit which penetrates all of the layers of the blister package 12 of the invention, and functions to stop the nonrupturable film layer 18 from being pulled across any article-receiving pockets 26 which may be adjacent to the article-receiving pocket 26 being accessed, and which are located in the direction that the nonrupturable film layer 18 is being pulled. Thus, the nonrupturable film layer divider 46 will prevent a young child or user of the blister package 12 from accessing the contents of all article receiving pockets 26 which are located in the direction that the nonrupturable film layer 18 is being pulled other than the one the young child or user is attempting to access. This is a safety feature of the present invention which serves to limit the number of article receiving pockets 26 that a young child or user of the blister package 12 can access at one time.

The blister packages 12 of the invention may optionally have one or more support ridges 48 which function to provide support to the blister packages 12, so that the blister packages 12 cannot easily be bent or folded.

While the various aspects of the blister packages 12 of the present invention are described herein with some particularity, those of skill in the art will recognize numerous modifications and variations which remain within the spirit of the invention. These modifications and variations are within the scope of the invention as described and claimed herein.

All starting materials and equipment used to prepare the blister packages of the invention are commercially available. Generally, these starting materials were obtained from James River Corp., Milford, N.J.; Reynolds Metals Company, Richmond, Va.; Dupont, Wilmington, Del.; Morton Chemicals, Chicago, Ill.; Klockner-Pentaplast of America, Inc., Gordonsville, Va.; Uhlmann Packaging Systems, Inc., Fairfield, N.J.; Aylward Enterprises, Inc., New Bern, N.C.; and Service Industries Midwest, Inc., Rolling Meadows, Ill., 60008.

All patents and publications referred to throughout the specification are hereby incorporated herein by reference, without admission that such is prior art.

(2) Operation of the Blister Packages

The operation of the blister package 12 described herein will be described with regard to the embodiment illustrated in FIG. 1. The patient or other user desiring to obtain a unit or multiple dose of medication or other article 34 from the blister package 12 of the invention first penetrates the blister sheet 24 by applying pressure with his fingers to the center of the blister sheet 24 to puncture the plurality of perforations 28 which form the shape of a "T." The user then turns the blister package 12 over, so that the top layer 14 is facing the user, grips one of the pull tabs 30 which have been generated by puncturing the plurality of perforations 28 and peals the pull tab 30 from the blister sheet 24 by pulling the pull tab 30 outwardly towards the edge 40 of the blister package 12 across and past the article-receiving pocket 26 being accessed. This has the effect of pulling the nonrupturable film layer 18 off of the rupturable film layer 20 in the area of the article-receiving pocket 26 over which the pull tab 30 is being pulled, so that the rupturable film layer 20 remains over the article-receiving pocket 26 to which access is desired by the user. The user can then turn the blister package 12 over again, so that the blister sheet 24 is facing him, apply pressure to the article-receiving pocket 26 and physically push the article 34 through the rupturable film layer 20 and thereby out of the blister package 12.

(3) Utility

The novel tamper-evident, child-resistant blister packages of the invention are useful for housing medicaments and other articles, such as small and/or dangerous articles, which should be kept beyond the reach of young children and impaired adults. These blister packages provide a clear indication when the packages have been subject to tampering, while being highly resistant to opening by young children and impaired adults but, at the same time, being sufficiently easy for the average consumer to open.

(4) Safety Features of the Blister Packages

Because of all of the steps involved in accessing a medicament or other article 34 contained in a blister package 12 of the invention, it is more difficult for a young child or impaired adult to gain access to the article 34 when compared to blister-type packages described in the art. Each of the steps described hereinabove which are involved in accessing the article 34 from the blister package 12 of the invention makes it more difficult for a young child or impaired adult to access the article 34. Because of the individual steps involved for the access of each article 34 from the blister packages 12 of the invention, it will be much more difficult, and much more time-consuming, for a young child or impaired adult to gain access to, and swallow, multiple unit doses of medication or other articles 34 from these packages 12.

In addition, because the blisters package 12 cannot be opened at any of their outer edges 40, but can only be opened by puncturing the perforations 28 located centrally between two article-receiving pockets 26, the medication or other article 34 cannot be accessed from any of the four outer edges 40 of the blister package 12.

Another safety feature of the blister package 12 of the invention with respect to the access of articles 34 is that, unlike blister-type packages described in the art, the blister package 12 of the present invention is subdivided into separate divisions, each of which is separately openable in the manner described above, but which is not separable from the package 12 itself. Thus, all articles 34 must be removed from the original blister package 12 itself. Unlike many of the blister-type packages described in the art, such as those disclosed in U.S. Pat. No. 3,921,805, in which the blister-type packages contain perforations which allow each unit or multiple dose of medication or other article contained therein to be separated from the original package into its own separate, individual package, the blister packages 12 of the present invention do not permit such separation of the original blister package 12 into separate, individual packages.

In addition, the blister packages 12 of the invention have pull tabs 30 which are designed to be pulled away from, rather than towards, other article-receiving pockets 26 which may be present in the blister packages 12. Because of this fact, and because embodiments of the blister package 12 of the invention which have more than 2 article receiving-pockets 26 generally have one or more nonrupturable film layer dividers 46 which function to stop the nonrupturable film layer 18 from being pulled across any article receiving pockets 26 which may be adjacent to the article receiving pocket 26 being accessed, a child or user of the blister packages 12 can only access one unit dose of medication or other article 34 at a time, whether deliberately or inadvertently. For each unit dose of medication or other article 34 to be accessed, a separate pull tab 30 must be pulled, and the corresponding rupturable film layer 20 which lies across that article-receiving pocket 26 will have to be separately physically ruptured. This is another important safety feature of the blister packages 12 of the invention. This safety feature of the blister packages 12 of the invention also distinguishes these blister packages 12 from the blister-type packages described in the art.

Clear evidence that the blister package 12 of the invention has been tampered with includes each of the following five indications of tampering: (1) having some or all of the perforations 28 punctured; (2) having one or more of the pull tabs 30 generated; (3) having one or more of the pull tabs 30 pulled across one or more of the article-receiving pockets 26; (4) having the rupturable film layer 20 ruptured; and/or (5) having an article 34 missing from one or more of the article-receiving pockets 26.

(5) Top Layer

The top layer 14 of the blister package 12 of the invention is conventionally formed from a single sheet of paper, from any type of printable film, such as polyethylene terephthalate (PET) or polyvinyl chloride (PVC), or from any other suitable material. All of these materials are commercially available. Preferably, calendared bleach paper, which is commercially available (James River Corp., Milford, N.J.), suitably punched out and perforated, adhesively coated with an adhesive layer 16 on the inner surface 44 of the top layer (on that face of the top layer 14 which will be adhered to the nonrupturable film layer 18), as with polyethylene or other suitable adhesive, and folded over to sandwich other components of the blister package 12, is employed.

The top layer 14 may be of any convenient basis weight. While bleached Kraft or calendared bleach paper having a basis weight of from about 20 to about 30 pounds per ream is preferred, calendared bleach paper having a basis weight of about 25 pounds per ream is most preferred.

Because, unlike many of the blister-type packages described in the art, the top layer 14 of the blister package 12 of the invention is not attached to a card, paper board, or other like material, the effort and expense of manufacturing these blister packages 12 is reduced.

The size and shape of the top layer 14 will be the same size and shape of the blister package 12 of the invention. Thus, it may be any convenient size, and any convenient shape, such as square, rectangular, triangular, round, or oval. The size of the top layer 14 will vary, depending upon the number of article-receiving pockets 26 which are contained therein. Preferably, the top layer 14 will be of a size ranging from about 12 inches×12 inches to about 1 inch×1 inch, and more preferably about 3 inches×2 inches.

Optionally, the top layer 14 of the blister package 12 may contain on its outer surface 42 (the surface of the top layer 14 which will not be adhered to the nonrupturable film layer 18) printed information, such as the chemical name, dosage, strength, trademark, tradename and/or manufacturing company name for any medication contained therein, instructions to the user concerning the steps involved in accessing the medication or other article 34 contained therein, regulatory requirements, handling conditions, precautions, such as a warning to the user to keep the blister package out of the reach of children, and/or other like information.

(6) Adhesive Layer

The adhesive layer 16 is a layer of material which is optionally employed in the blister packages 12 of the invention to adhere the nonrupturable film layer 18 to the top layer 14.

Examples of materials which are suitable for use as the adhesive layer 16 are known by those of skill in the art, and include polyethylene, polyester, vinyl and acrylics. All of these materials are commercially available. Preferably, a commercially-available urethane thermoset (Reynolds Metals Company, Richmond, Va.) is employed as the adhesive layer 16.

The adhesive layer 16 may be applied by methods known by those of skill in the art, such as by curtain or roller coatings, in an amount ranging from about 2.0 pounds per ream to about 1.4 pounds per ream.

(7) Nonrupturable Film Layer

The nonrupturable film layer 18 may be adhered to the inner surface 44 of the top layer by an adhesive layer 16 or otherwise, such as by the application of heat and/or pressure, and lies over all of the article-receiving pockets 26 which may be present in the blister package 12 to enclose the pockets 26 in a manner such that they cannot be ruptured.

The purpose of the nonrupturable film layer 18 is to prevent a young child or impaired adult from accessing a medicament or other article 34 contained in an article-receiving pocket 26 by merely applying pressure to the article-receiving pocket 26. Because the nonrupturable film layer 18 is made of a material which cannot be ruptured by the application of pressure, or by biting, the user of the blister package 12 of the invention must pull the nonrupturable film layer 18 away from the article-receiving pocket 26 in order to obtain access to the article 34 contained in the pocket 26.

The nonrupturable film layer 18 can be selected from a layer or sheet of a strong flexible material of sufficient tear strength that a pill or other article 34 cannot be forced through the material with the application of pressure, and cannot be accessed by biting through the material. A wide variety of commercially-available plastic or other materials may be employed as the nonrupturable film layer 18. The nonrupturable film layer 18 may be made of a tough tear-resistant plastic material, such as polyethylene terephthalate, reinforced acetal resins sold commercially under the brand name Derlin, or other tough material.

A sheet of polyester material has been found to have sufficient strength to prevent a pill from being forced therethrough or otherwise accessed. A strong polyester material which has been found to be particularly effective and, thus, which is preferred as the nonrupturable film layer 18 is 48 gauge polyethylene terephthalate, which is commercially available (MYLAR ®, Dupont, Wilmington, Del.). Polyethylene terephthalate is a polymeric plastic which is sold commercially under several brand names.

Among other materials which may be used as the nonrupturable film layer 18 are commercially-available polyester, polyolefin, polyamide, polycarbonate and polysulfone films, or combinations thereof. However, any material with strength sufficient to prevent a pill or other article 34 from being hand-forced therethrough, or from being accessed by biting, can be used for this purpose. Examples of nonrupturable film layers 18 are well known in the art.

Optionally, non-plastic protective layers, such as paper or cardboard, may be employed in addition to this layer, and in addition to the rupturable film layer 20 and to the top layer 14.

The thickness of the nonrupturable film layer 18 is not critical, although it should have sufficient thickness to avoid accidental rupture. Such thickness will vary with the selection of a particular material for use as the nonrupturable film layer 18, and can readily be determined by those persons skilled in the art. Typically, the nonrupturable film layer may have a thickness in the range of from about 0.5 mm to about 4 mm, preferably from about 0.5 mm to about 1.5 mm, such as about 0.75 mm.

The nonrupturable film layer 18 will generally be of the shape and size of the blister package 12, but may be of any convenient shape and size, as long as it is large enough to cover any article-receiving pocket 26 present in the blister package 12.

The nonrupturable film layer 18 may be co-extensive with the blister sheet 24, and may be joined to the blister sheet 24 by conventional heat-sealable coatings or otherwise. However, the nonrupturable film layer 18 is not attached to the blister sheet 24 in the area of the triangular shaped depression 36, as is discussed in more detail hereinbelow.

(8) Pressure-Sensitive Adhesive Layer

The nature of the pressure sensitive adhesive layer 19, or the like, which optionally joins the nonrupturable film layer 18 to the rupturable film layer 20 will depend upon the materials used in forming the rupturable film layer 20 and the nonrupturable film layer 18.

The pressure sensitive adhesive layer 19, in all cases, must be of such a nature that it permits the nonrupturable film layer 18 to be peeled away from the underlying rupturable film layer 20 without causing a rupture of the underlying rupturable film layer 20. Accordingly, the pressure sensitive adhesive layer 19 employed must either result in a high adherence to the nonrupturable film layer 18 and a relatively low adherence to the rupturable film layer 20, or vice versa. Typical adhesives which exhibit this quality, and which are commercially available, include rubber, vinyl, and acrylic cements.

In a preferred embodiment of the invention, where a metallic foil is employed as the rupturable film layer 20 and a polyester is employed as the nonrupturable film layer 18, an adhesive comprising rubber or acrylic cement is preferred. Thermoplastic rubber, which is commercially available from Reynolds Metals Company, Richmond, Va., is most preferred.

The pressure-sensitive adhesive layer 19 may be applied by methods known by those of skill in the art, such as by curtain or roller coating, in an amount ranging from about 0.75 pounds per ream to about 1.25 pounds per ream.

(9) Rupturable Film Layer

The rupturable film layer 20 may be attached to the blister sheet 24 by methods known by those of skill in the art, such as heat-sealing, solvent welding, gluing or otherwise adhering this layer to the blister sheet 24. However, the rupturable film layer 20 is not attached to the blister sheet 24 in the area of the triangular shaped depression 36, as is discussed in more detail hereinbelow.

This rupturable film layer 20 of the blister packages 12 of the invention can prevent moisture and contaminants from penetrating into the article-receiving pockets 26.

Unlike the nonrupturable film layer 18, the rupturable film layer 20 may be ruptured by the application of pressure. Thus, once the nonrupturable film layer 18 is peeled away from the rupturable film layer 20, the medicament or other article 34 contained in an article-receiving pocket 26 may be accessed by the application of pressure on the article 34 in the direction towards the rupturable film layer 20.

The rupturable film layer 20 is preferably formed from a fragile material, such as paper, selected plastics, such as cellophane, polyethylene, polypropylene, foil and other materials known by those of skill in the art, all of which are commercially available.

Because the materials described directly above are not readily heat sealable to the blister sheet 24 to form an air-tight sealed package, it is generally necessary, with such materials, to provide a layer of a heat sealable coating material 22 on the surface of the rupturable film layer 20 which faces the blister sheet 24. Such coatings are well known in the art, and may be selected from such materials as vinyls, acrylics or polyolefins, which are applied by spraying, dipping or similar techniques.

The thickness of the rupturable film layer 20 is not critical, and ordinarily will be maintained within a range which provides adequate protection for the package contents, while still being capable of rupture without the application of undue force, such as a thickness ranging from about 0.00035 inches to about 0.03 inches, preferably about 0.001 inches.

The rupturable film layer 20 is preferably a metal foil, preferably aluminum foil, which is commercially available from Reynolds Metals Company, Richmond, Va., of about 0.001 inches thick.

The rupturable film layer 20 may be of any convenient shape and size, but must be large enough to cover any article receiving pockets 26 which may be present in the blister package 12. This layer will generally be the same size and shape as the blister package 12 itself, and as the blister sheet 24.

(10) Heat Seal Coatings

A heat seal coating 22 or the like is optionally employed in the blister packages 12 of the invention to secure the rupturable film layer 20 to the blister sheet 24.

Many commercially-available heat-seal coating 22 formulations are known by those of skill in the art and can optionally be used to provide heat-sealability between these two different layers of the blister packages 12 of the present invention. Such coatings may be selected from materials such as vinyls, acrylics or polyolefins, which are applied by common methods, for example, spraying, dipping, curtain coating, roller coating or similar techniques, as known in the art. These heat-seal formulations are commonly used in making foil/paper and resin sheet/resin sheet laminates for soap wraps, carton overwraps, cereal liners, cookie wraps, and other uses.

The heat-seal coating 22 formulations are typically a water dispersion of a vinyl resin or a vinyl resin containing wax for providing lower heat-sealing temperatures. The vinyl resin can be ion-linked and acid-modified ethylene interpolymers known as ionomer resins. Wax and other modifiers further extend the range of performance properties.

The preferred heat-seal coating 22 formulations for use in the present invention are water dispersions of ethylene interpolymers, for example, ethylene/vinyl acetate interpolymers. The vinyl resin formulations combine broad adhesion properties with moderate hot tack. Modifiers such as pigments, waxes or other resins can be used. The most preferred heat seal coating 22 for use in the present invention is acrylic-modified vinyl, which is commercially available from Morton Chemicals, Chicago, Ill.

The heat-seal coatings 22 may be applied by methods known by those of skill in the art, such as by curtain or roller coatings, in an amount ranging from about 2.4 pounds per ream to about 3.6 pounds per ream, preferably about 3.0 pounds per ream.

(11) Blister Sheet

The blister sheet 24 may be a rectangular continuous blister sheet of a flexible transparent film or plastic which cannot easily be ruptured by biting or tearing or other means. Such a sheet 24 may be, for example, a vinyl thermoplastic film of about 15 mm thick.

The blister sheet 24 is made in a manner known by those of skill in the art, such as by extrusion, blown or tenter processes.

The blister sheet 24 may be square, triangular, round, oval or of any other convenient shape.

If desired, the blister sheet 24 may be made of an opaque or amber material so as to prevent light f om reaching medications which deteriorate when exposed to light.

The blister sheet 24 may be of any convenient size, but preferably ranges from about 12 inches×12 inches to about 1 inch×1 inch, most preferably about 3 inches×2 inches.

Materials which may be used for the blister sheet 24 are known by those of skill in the art, are commercially available and include a variety of polymers and copolymers, such as polyvinyl chloride, nylon, polyethylene terephthalate, polyethylene, polypropylene, polystyrene and similar materials. Preferably, polyvinyl chloride of a thickness of about 15.0 mm is employed. This is commercially available from Klockner-Pentaplast, Gordonsville, Va.

The rupturable film layer 20 is sealed using conventional sealing techniques onto that surface of the blister sheet 24 which does not have article-receiving pockets 26 protruding therefrom. For example, a conventional sealant can be used to close the article-receiving pockets 26 or, preferably, a heat seal coating 22 can be used, as described in detail herein.

The blister sheet 24 has an outer surface (that surface of the blister sheet 24 which is not adhered to the rupturable film layer 20) and an inner surface (that surface of the blister sheet 24 which is adhered to the rupturable film layer 20), with from one to a plurality of separate, flexible article-receiving pockets 26 projecting from its outer surface to contain medications and/or other articles 34 of any desired shape, and which generally conform to the size and/or shape of the particular articles 34 to be contained within the article-receiving pockets 26. One or more article-receiving pockets 26 may be cold-, thermo- or pressure-formed into the blister sheet 24 by conventional forming methods known by those of skill in the art. They may be spaced apart at regular intervals and may house one or more medicaments or other articles 34.

The blister sheet 24 will generally also contain perforations 28, one or more die cuts 32, one or more triangular-shaped depressions 36 and one or more nonrupturable film layer dividers 46, all of which are formed into the blister sheet 24 by conventional methods known by those of skill in the art, as is described in more detail hereinbelow. It is convenient to apply the rupturable film layer 20 to the flat surface of the blister sheet 24 and to thereafter form the perforations 28, die cuts 32 and nonrupturable film layer dividers 46, stretching the rupturable film layer 20 slightly in the process.

In order to prevent a child or impaired adult from tearing, biting through or otherwise rupturing the blister sheet 24 and obtaining access to the contents of the blister package 12, the thickness of the blister sheet 24 should range from about 7.5 mm to about 30 mm, and should preferably be about 15 mm. Studies have shown that young children, who generally have sharp teeth, have bitten through blister sheets 24 having a thickness of 10 mm. In addition, it is generally not practical to have a blister sheet 24 of a thickness greater than 15 mm.

The article-receiving pockets 26 of the blister packages 12 of the present invention are generally filled with the desired medicaments or other articles 34 prior to having the blister sheet 24 adhered to the other layers of the blister package 12.

(12) Article-receiving Pockets

From one to any plurality (such as two, four, ten, twenty, thirty, forty, fifty, etc.) of article-receiving pockets 26 are cold-, pressure- or thermal-formed into the blister sheet 24 of the blister packages 12 of the invention by conventional forming methods known by those of skill in the art.

The article-receiving pockets 26 of the blister packages 12 of the invention are generally flexible bubbles molded into the blister sheet 24 which form separate compartments for one or more medicaments or other articles 34, and which project from the outer surface of the blister sheet 24 (that surface of the blister sheet 12 which is not attached to the rupturable film layer 20).

The article-receiving pockets 26 are generally spaced from each other at regular intervals ranging from about 1/16 of an inch to about 10 inches, preferably from about ¼ of an inch to about 3 inches, most preferably about ¾ of an inch, but may be spaced in any other desired manner.

The article-receiving pockets 26 may be of any convenient size. For medicaments, the pockets 26 will generally range in size from about 1 mm×1 mm to about 50 mm×50 mm, preferably from about 1 mm×1 mm to about 10 mm×10 mm.

The article-receiving pockets 26 may be of any desired shape generally conforming to the shape of the particular article 34 to be contained within the article-receiving pocket 26, such as round, oval, triangular, square or rectangular.

(13) Perforations

The perforations 28 which penetrate the entire blister packages 12 of the invention preferably collectively form the shape of a "T," as is shown in the drawings, but may form any other desired shape which will allow the perforations 28 to serve their purpose. For example, if the blister package 12 has only one article-receiving pocket 26, the perforations 28 will generally collectively form the shape of a right angle.

The perforations 28 will generally be located adjacent the article-receiving pocket 26 where the blister package of the invention 12 contains one article-receiving pocket 26, and between each of two article-receiving pockets 26 in a set where the blister package of the invention 12 contains two or more article-receiving pockets 26, as is shown in the drawings. The spacing of the plurality of perforations 28 away from an article-receiving pocket 26 is not critical, and may vary from between about 1/32 of an inch to about 5 inches, preferably from about 1/16 of an inch to about 2 inches, most preferably about ¼ of an inch.

Where the blister package 12 of the present invention contains only one article-receiving pocket 26 and the perforations form the shape of a right angle, the perforations 28 are preferably located to either side of the article-receiving pocket 26 so that one side of the right angle is approximately parallel with the article-receiving pocket 26 and the other side of the right angle is above the article-receiving pocket 26 (in the direction away from the edge 40 of the blister package 12 and towards the center of the blister package 12). However, the specific placement of the perforations 28 is not critical, as long as they can serve their function, as described hereinbelow.

Where the blister package 12 of the present invention contains 2 or more article-receiving pockets 26 and the perforations 28 form the shape of a "T," the perforations 28 are preferably located centrally between each set of two article-receiving pockets 26, with the vertical part of the "T" extending between two article-receiving pockets 26 and the horizonal part of the "T" located along both of the article-receiving pockets 26, as is illustrated in the drawings. Thus, each set of two article-receiving pockets 26 will generally have these "T"-shaped perforations located centrally between the two pockets 26. However, the specific placement of the perforations 28 is not critical, as long as they can serve their function, as described directly below.

The perforations 28 serve to limit the amount of nonrupturable film layer 18 which can be removed from the blister package 12 in a single stripping operation, such that only the nonrupturable film layer 18 covering a single article-receiving pocket 26 can be removed in a single stripping step. This is a major deterrent to children. For example, as illustrated in FIG. 9 of the drawings, if it is desired to remove a single article 34 from the blister package 12 of the invention, the stripping of the nonrupturable film layer 18 away from the rupturable film layer 20 will be limited to the area defined by: (1) group of perforations 28*a* and group of perforations 28*b;* or (2) group of perforations 28*b* and group of perforations 28*c*. Thereafter, only the portion of the rupturable film layer 20 which was below the nonrupturable film layer 18 stripped away and over the article receiving pocket 26 will be capable of being ruptured by the application of pressure from the fingers of the user.

For a blister package 12 containing a medicament, and when the perforations 28 form the shape of a right angle, each portion of the right angle is preferably about ½ half of an inch. When the perforations 28 form the shape of a "T," the cross (horizontal) portion of the "T" is preferably about 1 and ½ half inches, while the leg (vertical) portion of the "T" is preferably about ½ of an inch. However, these measurements are not critical, and may be varied from between about 1/16 of an inch to about 12 inches for both portions of the right angle.

The length of each perforation 28 may range from about 1/32 of an inch to about 4 inches, more preferably from about 1/16 of an inch to about 1 inch, most preferably about ¼ of an inch.

The number of perforations which may be present in a particular blister package 12 of the invention is not critical, and will depend upon the number of article-receiving pockets 26 which are present in the package 12. This number may vary from about 2 to about 10,000, more preferably from about 4 to about 5,000, still more preferably from about 4 to about 2,000, and most preferably from about 5 to 15, depending upon the size of the "T" or the right angle or other shape formed by the perforations 28, and depending upon the size of the perforations 28.

The perforations 28 are die cut slits which penetrate all of the layers of the blister package 12 of the invention, and which are cut into the blister package 12 by a steel rule die under pressure, as is known by those of skill in the art.

The perforations are spaced apart by interruptions 38 ranging from about 1/100 of an inch to about ¼ of an inch, preferably about 1/16 of an inch in length.

(14) Pull Tabs

A manually-grippable pull tab 30 comprising a free portion of the top layer 14, the optional adhesive layer 16, the nonrupturable film layer 18, the optional pressure sensitive adhesive layer 19 and the rupturable film layer 20 is generated for each article-receiving pocket 26 when the blister package 12 of the invention is penetrated by puncturing the group of perforations 28 which penetrate the blister sheet 24 downwards towards the top layer 14.

The size and thickness of the pull tab 30 is not critical, as long as the pull tab 30 is large enough and thick enough to be manually gripped by the user of the blister package 12.

While the pull tab 30 is generally of a triangular shape, the shape of the pull tab is not critical, so long as it is of a shape which conveniently allows the user of the blister package 12 to manually grip the pull tab 30.

(15) Die Cuts

The die cut 32 is located between the group of perforations 28 and each of the article-receiving pocket 26, exterior to and parallel to that side of a triangular-shaped depression 36 which is present in the blister sheet 24, and directly above an article-receiving pocket 26.

The die cut 32 is a cut or slit which penetrates the entire blister package 12, and which is conventionally cut into the blister package 12 by a steel rule die under pressure, as known by those of skill in the art.

The die cut 32 functions to separate the nonrupturable film layer 18 from the rupturable film layer 20, which remains adhered to the blister sheet when a pull tab 30 is pulled across a die cut 32 and over an article-receiving pocket 26. Thus, when a pull tab 30 is pulled across a die cut 32 and over an article-receiving pocket 26, the rupturable film layer 20 remains adhered to the blister sheet 24, but the nonrupturable film layer 18 is pulled off of the rupturable film layer 20, so that the remaining rupturable film layer 20 is exposed to the user and can be physically ruptured to access the medication or other article 34 contained in an article-receiving pocket 26, as hereinbefore described.

Each die cut 32 is most preferably about 2/16 of an inch in length, but may range from about 1/32 of an inch to about 2 inches in length, preferably from about 1/16 of an inch to about ¼ of an inch in length.

(16) Triangular-Shaped Depressions

The blister sheet 24 contains one or more recessed triangular shaped depressions 36, which is cold-, pressure- or thermal-formed into the blister sheet 24 by conventional forming techniques known by those of skill in the art. The depressions 36 project into the blister sheet 24 in the same direction as that of the article receiving pockets 26.

An unsealed area exists in the area of the triangular-shaped depression 36 between the blister sheet 24 and the rupturable film layer 20 of the blister package 12. Because the rupturable film layer 20 is not adhered to the blister sheet 24 in the area of the triangular-shaped depression 36, the recessed triangular shaped depression 36 facilitates the formation of the pull tabs 30.

The unsealed area can be provided in a number of ways. For example, when the rupturable film layer 20 is laminated to the blister sheet 24, pressure and/or heat can be omitted from a predetermined area corresponding to the triangular-shaped area leaving an unsealed area. Other methods for providing the unsealed area include omitting a heat-seal coating 22 between the rupturable film layer 20 and the blister sheet 24 in such area. In the same manner, adhesive coatings and extruded polyethylene adhesive layers can be applied between the blister sheet 24 and the rupturable film layer 20 except for the predetermined triangular-shaped area.

Although it is convenient to have the triangular-shaped depression 36 be in the shape of a triangle, the shape of the depression is not critical, and may be other shapes, such as a square, rectangular, round or oval.

The triangular-shaped depression 36 may be depressed or recessed into the blister sheet 24 from about 0.1 mm to about 25 mm, preferably from about 1 mm to about 5 mm, most preferably 3 mm.

The triangular-shaped depression 36 preferably measures about 0.25×0.25×0.38 inches. However, these measurements are not critical, and each of the three sides of the depression 36 may range from about 1/32 of an inch to about 3 inches, preferably from about ⅛ of an inch to about ½ of an inch.

(17) Nonrupturable Film Layer Divider

In embodiments of the blister package 12 of the invention which have more than two article receiving pockets 26, such as the embodiment of the invention illustrated in FIGS. 7–9, which contains 10 article receiving pockets 26, the blister package 12 will generally have one or more nonrupturable film layer dividers 46.

The nonrupturable film layer divider 46 is a die cut slit which penetrates all of the layers of the blister package 12 of the invention, and which is cut into the blister package 12 by a steel rule die under pressure, as known by those of skill in the art.

In embodiments of the blister package 12 of the invention which have more than two article receiving pockets 26, the nonrupturable film layer divider 46 functions to stop the nonrupturable film layer 18 from being pulled across any article receiving pockets 26 which may be adjacent to the article receiving pocket 26 being accessed, and which are located in the direction that the nonrupturable film layer 18 is being pulled. Pulling of the nonrupturable film layer 18 across the divider 46 causes such nonrupturable film layer 18 to tear and, thereby, not disturb the nonrupturable film layer 18 lying beyond the divider 46 in the direction of the pull. Thus, the nonrupturable film layer divider 46 will prevent a young child or user of the blister package from accessing the contents of all article receiving pockets 26 which are located in the direction that the nonrupturable film layer 18 is being pulled other than the one the young child or user is attempting to access. This is a safety feature of the present invention which serves to limit the number of article receiving pockets 26 that can be accessed at one time.

The nonrupturable film layer divider 46 may be of any convenient width and length, but preferably ranges from about ⅛ of an inch to about 10 inches in length and about 0.00028 inches to about ¼ of an inch in width, most preferably about ½ of an inch in length and about 1/16 of an inch in width.

The shape of the nonrupturable film layer divider 46 is not critical and, thus, may vary (i.e., may be straight, round, square, rectangular, triangular, etc.), as long as it has the safety function of stopping the nonrupturable film layer 18 from being pulled across any article receiving pockets 26 which may be adjacent to the article receiving pocket 26 being accessed, and which are located in the direction that the nonrupturable film layer 18 is being pulled. However, a straight die cut, such as the nonrupturable film layer dividers 46 illustrated in FIGS. 7–9, is preferred.

The number of nonrupturable film layer dividers 46 which may be present in a blister package 12 of the invention will vary depending upon the number of article receiving pockets 26 which are present in the package 12. Generally, where all of the article receiving pockets of a blister package of the invention are arranged in a straight line, there will be 1 nonrupturable film layer divider for every 1 or 2 article receiving pockets which are in addition to the first 2 article receiving pockets (i.e., 0 for 2 article receiving pockets; 1 for 3 or 4 article receiving pockets; 2 for 5 or 6 article receiving pockets; 3 for 7 or 8 article receiving pockets; 4 for 9 or 10 article receiving pockets, etc.). However, these numbers will vary when the article receiving pockets of the blister package are not arranged in a straight line. For example, the embodiment of the invention illustrated in FIGS. 7–9 has 10 article receiving pockets arranged in the shape of a "C," rather than in a straight line, and, thus, only requires 2 nonrupturable film layer dividers for 10 article receiving pockets. Some of the perforations which are present in this embodiment of the invention serve the same function as the nonrupturable film layer dividers. Thus, fewer nonrupturable film layer dividers are required for safety purposes in this embodiment of the invention.

The nonrupturable film layer divider 46 is generally placed perpendicular to the horizonal portion of the "T" which is formed by the perforations 28 between 2 article receiving pockets 26 in which no perforations 28 are present, as is shown in FIGS. 7–9. It is generally located from about 1/100 of an inch to about 10 inches, more preferably from about ¼ of an inch to about 1 inch, and most preferably about ½ of an inch, away from each of the two article receiving pockets 26 which it divides. However, the exact positioning and spacing of the nonrupturable film layer divider 46 between 2 article receiving pockets 26 is not critical and may vary.

(18) Support Ridges

The blister packages 12 of the invention may optionally have one or more support ridges 48 which function to provide support to the blister package 12, so that the blister package 12 cannot easily be bent or folded.

Like the article receiving pockets 26 of the blister packages 12 of the invention, the support ridges are recesses which are cold-, thermal- or pressure-formed into the blister sheet 24 by conventional forming techniques known by those of skill in the art. They are recessed into the blister sheet 24 in the same direction as are the article-receiving pockets 26 and triangular shaped depressions 36.

The support ridges 48 may be of any shape, such as square, rectangular, triangular, round, oval or a straight line, but are preferably a straight line or rectangular. A blister package 12 may have support ridges 48 of different shapes, as well, such as is shown in FIG. 1.

The number of support ridges 48 that the blister packages 12 may have is not critical, and may vary depending upon the size of the particular blister package 12 and the amount of support for the package 12 that is desired.

The size of the support ridges 48 is not critical and may also vary, depending upon the size of the particular blister package 12 and the amount of support for the package 12 that is desired.

Although the support ridges 48 may be positioned anywhere on the blister package 12, they are preferably placed close to the outer perimeter of the package 12.

(19) Methods of Preparation of the Blister Packages

The blister packages 12 of the invention may be mass produced using readily-available starting materials and conventional production procedures.

For example, the blister sheet 24 may be unwound from a roll of the material. It may then be heated and, while it is in a molten state, have article receiving pockets 26, optional support ridges 48, and heat seal relief areas, such as the triangular shaped depressions 36, formed therein. The resulting formed web may then be passed through a filler, and the filler may load the medicaments or other articles 34 into the article receiving pockets 26 of the structure. The preferred lidding material laminate (top layer 14, adhesive layer 16, nonrupturable film layer 18, pressure sensitive adhesive layer 19, and rupturable film layer 20), which may be purchased as a preassembled laminate in accordance with the aforementioned specifications from Reynolds Metals Company, Richmond, Va., may, meanwhile, be unwinding from a second roll of material. It may then be positioned over the formed article receiving pockets 26. The lidding material laminate may then be heat sealed together to the blister sheet 24. The resulting structure may then travel to a perforating station where the perforations 28, die cuts 32 and nonrupturable film layer dividers 46 are appropriately die cut into the surface of the blister package 12 by a steel rule die under pressure. The resulting structure is die cut into individual blister packages 12 by a steel rule die under pressure.

The conditions for carrying out each of the individual steps in the production of the blister packages 12 of the invention are conventional, well-known and capable of wide variation. For example, materials and methods other than those described herein may be used to adhere the different layers of the blister packages 12 of the invention together. Those of skill in the art will readily understand that known variations of the conditions and processes of the preparative procedures described herein can be used to prepare the blister packages of the invention, and that other methods known in the art can also be used to produce the blister packages of the invention.

It is usually desirable to provide a paper sheet as the top layer 14 so that printing is easily read from the non-blister side of the package. However, the printed paper can be positioned next to a transparent blister sheet 24 and read through the blister sheet 24 from the top of the package.

The various layers of the blister packages 12 of the invention other than the blister sheet 24 can be laminated to form a single laminated sheet prior to being applied to the blister sheet 24, or the layers can be secured together at the same time they are adhered to the blister sheet 24, as known by those of skill in the art.

The preferred method of laminating is by using heat-seal coatings 22, preferably a peelable heat-seal coating.

When applied as a single lamination structure, the layers of the blister package 12 can be secured together by heat-sealing, solvent welding, gluing, applying sheets of adhesive materials between the layers, or otherwise adhering the layers together with the use of heat and/or pressure, as known by those of skill in the art. Heat-seal coatings can be used in addition to intermediate adhesive layers.

When heat-sealing is used to secure the lidding material laminate to the blister sheet 24, these two layers can be bonded by the application of heat between from about 300° to about 375° F. at about 50 kilotons (kN) of pressure from about 1 second to about 2 seconds dwell.

(20) Testing

As discussed hereinabove, the blister packages described herein have been found to be in compliance with standards of the Poison Prevention Packaging Act of 1970, 15 USC §1471-1475, and with its associated regulations, 16 CFR §1700-1700.20, which describe the test procedures in which the packages are given to children for a given period of time to determine the accessibility of the package contents.

(a) Testing of a Blister Package Containing 2 Article-Receiving Pockets 200 children, ages 42 to 51 months, evenly distributed by age and sex, and 100 adults, ages 18 to 45 years (70 females and 30 males) were tested according to the protocol described in the Poison Prevention Packaging Act of 1970 and its associated regulations, as discussed hereinabove, which are incorporated herein by reference, with a blister package of the invention containing 2 article-receiving pockets and produced with the following materials:

(a) top layer: 25# calendared bleached paper
(b) adhesive layer: a urethane thermoset weighing 1.75 pounds per ream
(c) nonrupturable film layer: 48 gauge polyester
(d) pressure sensitive adhesive layer: a thermoplastic rubber weighing 1.0 pounds per ream
(e) rupturable film layer: 0.001 inch aluminum foil
(f) heat seal coating: peelable acrylic modified vinyl weighing 3.0 pounds per ream
(g) blister sheet: 15.0 mm polyvinyl chloride Through toxicity analysis of the particular drug contained in the article receiving pockets of the blister packages employed in these studies (zolpidem tartrate or Ambien TM), it was determined that, for the study performed with the children, entry into 0 or 1 unit (article-receiving pocket) of the blister package would pass the safety standards described in the Poison Prevention Packaging Act of 1970, and that entry into 2 units or more of the blister package would fail these standards.

While the period of testing for the adults was 5 minutes, the period of testing for the children was 10 minutes.

The results of this study are presented in Table I (children) and in Table II (adults) hereinbelow. Failure for the particular drug employed in this study was defined as a child gaining access into more than 1 unit of the blister package.

In Table I and/or Table II, the following abbreviations are employed: (1) M—male; (2) FM—female; (3) P—indicates that a child peeled the nonrupturable film layer from the blister package; (4) CH—indicates that a child chewed on the blister package; (5) T—indicates that a child used teeth to bite through the blister package; and (6) F—indicates that a child used fingers to gain access to the contents of the blister package.

Following the established test procedures described in the Poison Prevention Packaging Act of 1970, and its associated regulations, without a demonstration of the opening procedures used for the blister packages employed in this study, 95% of the children tested in this study failed to gain entry to more than 1 unit of the blister package during the first five minutes of testing. Also without a demonstration of the opening procedures used for the blister packages employed in this study, 85.5% of the children tested failed to gain entry to more than 1 unit of the blister package during the entire 10 minutes of testing and, thus, passed the test. (136 children were not able to open any units. 35 children were able to gain access to only 1 unit of the blister package. 29 of the children were able to gain access to 2 units of the blister package. 120 children used their teeth on the blister packages, with 5 of these children having opened one or more units of the package using their teeth.)

Following the established test procedures described in the Poison Prevention Packaging Act of 1970, and its associated regulations, 100% of the adults tested were able to gain access to the contents of one or more units of the blister package within the 5 minutes allowed.

TABLE I

| AGE/ SEX (Mos) | PASS OR FAIL | (Children) TIME TO OPEN FIRST UNIT | MODE TIME OF FAILURE | UNITS OF OPENING | OPEN-ED |
|---|---|---|---|---|---|
| 42M | PASS | :* | : | | 0 |
| 42M | PASS | : | : | | 0 |
| 42M | PASS | : | : | | 0 |
| 42M | PASS | : | : | | 0 |
| 42M | PASS | : | : | | 0 |
| 42M | PASS | : | : | | 0 |
| 42M | PASS | : | : | | 0 |
| 42M | PASS | : | : | | 0 |
| 42FM | PASS | :** | : | | 0 |
| 42FM | PASS | 2:25 | : | F | 1 |
| 42FM | PASS | 9:15 | : | F | 1 |
| 42FM | PASS | : | : | | 0 |
| 42FM | PASS | : | : | | 0 |
| 42FM | PASS | : | : | | 0 |
| 42FM | PASS | : | : | | 0 |
| 42FM | PASS | : | : | | 0 |
| 42FM | PASS | : | : | | 0 |
| 42FM | PASS | : | : | | 0 |
| 42FM | PASS | : | : | | 0 |
| 43M | PASS | : | : | | 0 |
| 43M | PASS | : | : | | 0 |
| 43M | PASS | : | : | | 0 |
| 43M | PASS | : | : | | 0 |
| 43M | PASS | : | : | | 0 |
| 43M | PASS | : | : | | 0 |
| 43M | PASS | : | : | | 0 |
| 43M | PASS | 3:13 | : | F | 1 |
| 43M | PASS | 5:33 | : | T,F | 1 |
| 43M | PASS | : | : | | 0 |
| 43FM | PASS | : | : | | 0 |
| 43FM | PASS | : | : | | 0 |
| 43FM | PASS | : | : | | 0 |
| 43FM | PASS | : | : | | 0 |
| 43FM | PASS | : | : | | 0 |
| 43FM | PASS | : | : | | 0 |
| 43FM | PASS | : | : | | 0 |
| 43FM | PASS | : | : | | 0 |
| 43FM | PASS | 6:30 | : | F | 1 |
| 43FM | PASS | 6:31 | : | F | 1 |
| 44M | PASS | : | : | | 0 |
| 44M | PASS | : | : | | 0 |
| 44M | PASS | : | : | | 0 |
| 44M | PASS | : | : | | 0 |
| 44M | PASS | : | : | | 0 |
| 44M | PASS | : | : | | 0 |
| 44M | PASS | : | : | | 0 |
| 44M | PASS | : | : | | 0 |
| 44M | PASS | : | : | | 0 |
| 44M | PASS | : | : | | 0 |
| 44FM | FAIL | 5:16 | 5:40 | F | 2 |
| 44FM | PASS | : | : | | 0 |
| 44FM | PASS | : | : | | 0 |
| 44FM | PASS | : | : | | 0 |
| 44FM | PASS | 9:30 | : | F | 1 |
| 44FM | PASS | : | : | | 0 |
| 44FM | PASS | 6:54 | : | F | 1 |
| 44FM | PASS | : | : | | 0 |
| 44FM | PASS | : | : | | 0 |
| 44FM | PASS | : | : | | 0 |
| 45M | FAIL | 8:08 | 9:51 | F | 2 |
| 45M | PASS | : | : | | 0 |
| 45M | PASS | 4:05 | : | F | 1 |
| 45M | PASS | : | : | | 0 |
| 45M | PASS | : | : | | 0 |
| 45M | PASS | 7:58 | : | F | 1 |
| 45M | PASS | : | : | | 0 |
| 45M | PASS | : | : | | 0 |
| 45M | PASS | : | : | | 0 |
| 45FM | PASS | : | : | | 0 |
| 45FM | PASS | : | : | | 0 |

TABLE I-continued

| AGE/ SEX (Mos) | PASS OR FAIL | (Children) TIME TO OPEN FIRST UNIT | MODE TIME OF FAILURE | UNITS OF OPENING | OPEN-ED |
|---|---|---|---|---|---|
| 45FM | PASS | : | : | | 0 |
| 45FM | PASS | : | : | | 0 |
| 45FM | PASS | : | : | | 0 |
| 45FM | PASS | : | : | | 0 |
| 45FM | PASS | 5:40 | : | F | 1 |
| 45FM | PASS | : | : | | 0 |
| 45FM | PASS | : | : | | 0 |
| 45FM | PASS | : | : | | 0 |
| 45FM | PASS | : | : | | 0 |
| 46M | FAIL | 2:32 | 3.19 | F | 2 |
| 46M | FAIL | 4:19 | 5:14 | F | 2 |
| 46M | FAIL | 3:48 | 6:22 | F | 2 |
| 46M | PASS | 6:28 | : | T,F | 1 |
| 46M | PASS | : | : | | 0 |
| 46M | PASS | : | : | | 0 |
| 46M | PASS | : | : | | 0 |
| 46M | PASS | : | : | | 0 |
| 46M | PASS | : | : | | 0 |
| 46M | PASS | 7:34 | : | F | 1 |
| 46M | PASS | 4:01 | : | F | 1 |
| 46FM | FAIL | 6:02 | 9:03 | F,T | 2 |
| 46FM | PASS | : | : | | 0 |
| 46FM | PASS | : | : | | 0 |
| 46FM | PASS | : | : | | 0 |
| 46FM | PASS | : | : | | 0 |
| 46FM | PASS | : | : | | 0 |
| 46FM | PASS | : | : | | 0 |
| 46FM | PASS | : | : | | 0 |
| 47M | FAIL | 1:49 | 2:20 | F | 2 |
| 47M | FAIL | 4:25 | 5:00 | F | 2 |
| 47M | FAIL | 3:36 | 4:37 | F | 2 |
| 47M | PASS | : | : | | 0 |
| 47M | PASS | 7:56 | : | T,F | 1 |
| 47M | PASS | : | : | | 0 |
| 47M | PASS | : | : | | 0 |
| 47M | PASS | 9:09 | : | CH | 1 |
| 47M | PASS | : | : | | 0 |
| 47M | PASS | : | : | | 0 |
| 47FM | FAIL | 1:58 | 2:20 | F | 2 |
| 47FM | FAIL | 6:15 | 7:35 | CH | 2 |
| 47FM | FAIL | 1:58 | 2:35 | F | 2 |
| 47FM | PASS | : | : | | 0 |
| 47FM | PASS | : | : | | 0 |
| 47FM | PASS | 7:58 | : | T,F | 1 |
| 47FM | PASS | : | : | | 0 |
| 47FM | PASS | : | : | | 0 |
| 47FM | PASS | : | : | | 0 |
| 47FM | PASS | : | : | | 0 |
| 48M | FAIL | 7:51 | 8:40 | F | 2 |
| 48M | FAIL | 2:57 | 3:11 | F | 2 |
| 48M | PASS | : | : | | 0 |
| 48M | PASS | 7:06 | : | F | 1 |
| 48M | PASS | : | : | | 0 |
| 48M | PASS | : | : | | 0 |
| 48M | PASS | : | : | | 0 |
| 48M | PASS | 9:25 | : | T,F | 1 |
| 48M | PASS | : | : | | 0 |
| 48FM | FAIL | 7:37 | 7:56 | F | 2 |
| 48FM | FAIL | 3:38 | 4:24 | F | 2 |
| 48FM | FAIL | 3:04 | 4:07 | F | 2 |
| 48FM | FAIL | 7:20 | 8:35 | F | 2 |
| 48FM | FAIL | 9:10 | 9:37 | F | 2 |
| 48FM | PASS | : | : | | 0 |
| 48FM | PASS | : | : | | 0 |
| 48FM | PASS | 8:43 | : | F | 1 |
| 48FM | PASS | : | : | | 0 |
| 48FM | PASS | 8:44 | : | CH | 1 |
| 48FM | PASS | : | : | | 0 |
| 49M | FAIL | 4:07 | 5:39 | F | 2 |
| 49M | PASS | 6:12 | : | F | 1 |
| 49M | PASS | : | : | | 0 |
| 49M | PASS | : | : | | 0 |
| 49M | PASS | : | : | | 0 |
| 49M | PASS | : | : | | 0 |
| 49M | PASS | 6:54 | : | F | 1 |
| 49M | PASS | : | : | | 0 |

TABLE I-continued (Children)

| AGE/ SEX (Mos) | PASS OR FAIL | TIME TO OPEN FIRST UNIT | MODE TIME OF FAILURE | UNITS OF OPENING | OPEN-ED |
|---|---|---|---|---|---|
| 49M | PASS | 8:54 | : | F | 1 |
| 49M | PASS | 9:29 | : | F | 1 |
| 49FM | FAIL | 5:04 | 9:43 | F | 2 |
| 49FM | FAIL | 5:46 | 6:04 | F | 2 |
| 49FM | PASS | : | : | | 0 |
| 49FM | PASS | : | : | | 0 |
| 49FM | PASS | : | : | | 0 |
| 49FM | PASS | : | : | | 0 |
| 49FM | PASS | 9:58 | : | F | 1 |
| 49FM | PASS | : | : | | 0 |
| 49FM | PASS | : | : | | 0 |
| 49FM | PASS | : | : | | 0 |
| 50M | FAIL | 4:44 | 5:41 | F | 2 |
| 50M | PASS | 7:49 | : | F | 1 |
| 50M | PASS | : | : | | 0 |
| 50M | PASS | : | : | | 0 |
| 50M | PASS | : | : | | 0 |
| 50M | PASS | : | : | | 0 |
| 50M | PASS | 9:28 | : | T,F | 1 |
| 50M | PASS | : | : | | 0 |
| 50M | PASS | 9:17 | : | T,F | 1 |
| 50M | PASS | : | : | | 0 |
| 50M | PASS | : | : | | 0 |
| 50FM | FAIL | 6:34 | 8:01 | F | 2 |
| 50FM | FAIL | 5:27 | 8:27 | F | 2 |
| 50FM | FAIL | 6:15 | 7:38 | F | 2 |
| 50FM | PASS | : | : | | 0 |
| 50FM | PASS | : | : | | 0 |
| 50FM | PASS | 4:00 | : | T,F | 1 |
| 50FM | PASS | 8:14 | : | CH | 1 |
| 50FM | PASS | : | : | | 0 |
| 50FM | PASS | : | : | | 0 |
| 51M | FAIL | 3:40 | 6:56 | T,F | 2 |
| 51M | PASS | : | : | | 0 |
| 51M | PASS | : | : | | 0 |
| 51M | PASS | : | : | | 0 |
| 51M | PASS | : | : | | 0 |
| 51M | PASS | : | : | | 0 |
| 51M | PASS | 3:43 | : | T,F | 1 |
| 51M | PASS | : | : | | 0 |
| 51M | PASS | 8:03 | : | F,CH | 1 |
| 51M | PASS | : | : | | 0 |
| 51M | PASS | : | : | | 0 |
| 51FM | FAIL | 5:46 | 7:29 | F | 2 |
| 51FM | FAIL | 3:39 | 3:47 | T,F | 2 |
| 51FM | PASS | 7:15 | : | F | 1 |
| 51FM | PASS | 8:30 | : | CH | 1 |
| 51M | PASS | : | : | | 0 |
| 51M | PASS | : | : | | 0 |
| 51M | PASS | : | : | | 0 |
| 51M | PASS | : | : | | 0 |
| 51M | PASS | : | : | | 0 |

*For all of the studies presented herein where the symbol ":" appears without any numbers on either side of it, it means that the child was unable to gain access to any units of the blister package during the entire 10 minutes of testing.

**For all of the studies presented herein, where the symbol ":" appears with one or more numbers on either side of it, the numbers located to the left of the symbol mean minutes, and the numbers located to the right of the symbol mean seconds.

TABLE II (Adults)

| AGE (YEAR) | SEX | TIME TO OPEN | PASS OR FAIL |
|---|---|---|---|
| 37 | M | :25 | PASS |
| 39 | M | :47 | PASS |
| 42 | M | :52 | PASS |
| 25 | M | :57 | PASS |
| 42 | M | :49 | PASS |
| 35 | M | :27 | PASS |
| 39 | M | :42 | PASS |
| 32 | M | :42 | PASS |
| 43 | M | :28 | PASS |
| 18 | M | :18 | PASS |
| 26 | M | :29 | PASS |

TABLE II-continued (Adults)

| AGE (YEAR) | SEX | TIME TO OPEN | PASS OR FAIL |
|---|---|---|---|
| 45 | M | 3:27 | PASS |
| 38 | M | :21 | PASS |
| 35 | M | :27 | PASS |
| 36 | M | :19 | PASS |
| 38 | M | :22 | PASS |
| 38 | M | :20 | PASS |
| 37 | M | :31 | PASS |
| 35 | M | :31 | PASS |
| 30 | M | 1:49 | PASS |
| 30 | M | :49 | PASS |
| 31 | M | :42 | PASS |
| 35 | M | :52 | PASS |
| 31 | M | :56 | PASS |
| 38 | M | 1:02 | PASS |
| 39 | M | :07 | PASS |
| 29 | M | :21 | PASS |
| 41 | M | :44 | PASS |
| 30 | M | 1:00 | PASS |
| 38 | M | 1:48 | PASS |
| 21 | FM | 1:42 | PASS |
| 29 | FM | 1:17 | PASS |
| 27 | FM | :45 | PASS |
| 24 | FM | :38 | PASS |
| 19 | FM | :20 | PASS |
| 21 | FM | :34 | PASS |
| 30 | FM | 1:06 | PASS |
| 33 | FM | :14 | PASS |
| 37 | FM | :31 | PASS |
| 28 | FM | :32 | PASS |
| 32 | FM | :18 | PASS |
| 37 | FM | :27 | PASS |
| 48 | FM | :38 | PASS |
| 35 | FM | :42 | PASS |
| 23 | FM | :37 | PASS |
| 35 | FM | 1:34 | PASS |
| 30 | FM | :22 | PASS |
| 29 | FM | 1:10 | PASS |
| 34 | FM | :27 | PASS |
| 36 | FM | 2:06 | PASS |
| 36 | FM | :42 | PASS |
| 31 | FM | :46 | PASS |
| 29 | FM | :18 | PASS |
| 33 | FM | :45 | PASS |
| 31 | FM | :15 | PASS |
| 30 | FM | 1:27 | PASS |
| 39 | FM | :22 | PASS |
| 45 | FM | :47 | PASS |
| 31 | FM | :51 | PASS |
| 32 | FM | :25 | PASS |
| 39 | FM | :29 | PASS |
| 21 | FM | :23 | PASS |
| 41 | FM | 1:09 | PASS |
| 30 | FM | :42 | PASS |
| 29 | FM | :39 | PASS |
| 38 | FM | :39 | PASS |
| 36 | FM | :22 | PASS |
| 24 | FM | :49 | PASS |
| 35 | FM | :56 | PASS |
| 40 | FM | :43 | PASS |
| 19 | FM | :41 | PASS |
| 34 | FM | :51 | PASS |
| 20 | FM | :20 | PASS |
| 18 | FM | :14 | PASS |
| 23 | FM | 2:47 | PASS |
| 30 | FM | :42 | PASS |
| 29 | FM | :09 | PASS |
| 24 | FM | :25 | PASS |
| 29 | FM | :39 | PASS |
| 35 | FM | :47 | PASS |
| 23 | FM | :16 | PASS |
| 30 | FM | :29 | PASS |
| 36 | FM | :43 | PASS |
| 40 | FM | :47 | PASS |
| 39 | FM | :18 | PASS |
| 42 | FM | :43 | PASS |
| 43 | FM | :24 | PASS |
| 41 | FM | 1:18 | PASS |
| 23 | FM | :53 | PASS |

TABLE II-continued

| AGE (YEAR) | SEX | (Adults) TIME TO OPEN | PASS OR FAIL |
|---|---|---|---|
| 31 | FM | :50 | PASS |
| 39 | FM | 1:41 | PASS |
| 36 | FM | 1:01 | PASS |
| 29 | FM | 1:38 | PASS |
| 36 | FM | :34 | PASS |
| 36 | FM | :35 | PASS |
| 42 | FM | :38 | PASS |
| 42 | FM | :24 | PASS |
| 26 | FM | :45 | PASS |
| 44 | FM | :34 | PASS |
| 37 | FM | :24 | PASS |

(b) Testing of a Blister Package Containing 10 Article-Receiving Pockets 200 children, ages 42 to 51 months, evenly distributed by age and sex, and 100 adults, ages 18 to 45 years (70 females and 30 males) were tested according to the protocol described in the Poison Prevention Packaging Act of 1970, and its associated regulations, with a blister package of the invention containing 10 article-receiving pockets, and produced with the same materials described hereinabove in the studies involving a blister package of the invention containing 2 article-receiving pockets.

Through toxicity analysis of the particular drug contained in the article receiving pockets of the blister packages employed in these studies (zolpidem tartrate or Ambien TM), it was determined that, for the study performed with the children, entry into 0 or 1 unit (article-receiving pocket) of the blister package would pass the safety standards described in the Poison Prevention Packaging Act of 1970, and that entry into 2 units or more of the blister package would fail these standards.

While the period of testing for the adults was 5 minutes, the period of testing for the children was 10 minutes.

The results of this study are presented in Table III (children) and in Table IV (adults) hereinbelow.

In Table III and/or Table IV, all abbreviations employed are defined in the same manner as described hereinabove in the studies involving a blister package of the invention containing 2 article-receiving pockets.

Following the established test procedures described in the Poison Prevention Packaging Act of 1970, and its associated regulations, without a demonstration of the opening procedures used for the blister packages employed in this study, 96% of the children tested in this study failed to gain entry to more than 1 unit of the blister package during the first five minutes of testing. Also without a demonstration of the opening procedures used for the blister packages employed in this study, 85% of the children tested failed to gain entry to more than 1 unit of the blister package during the entire 10 minutes of testing and, thus, passed the test. (133 children were not able to open any units. 37 children were able to gain access to only 1 unit of the blister package. 20 of the children were able to gain access to 2 units of the blister package. 4 of the children were able to gain access to 3 units of the blister package. 2 of the children were able to gain access to 4 units of the blister package. 2 of the children were able to gain access to 5 units of the blister package. 2 of the children were able to gain access to 7 units of the blister package. 114 children used their teeth on the blister packages, with 4 of these children having opened one or more units of the package using their teeth.)

Following the established test procedures described in the Poison Prevention Packaging Act of 1970, and its associated regulations, 100% of the adults tested were able to gain access to the contents of one or more units of the blister package within the 5 minutes allowed.

TABLE III

| AGE/ SEX (Mos) | PASS OR FAIL | (Children) TIME TO OPEN FIRST UNIT | MODE TIME OF FAILURE | UNITS OF OPENING | OPENED |
|---|---|---|---|---|---|
| 42M | FAIL | 6:20 | 8:15 | F | 2 |
| 42M | PASS | : | : | | 0 |
| 42M | PASS | : | : | | 0 |
| 42M | PASS | : | : | | 0 |
| 42M | PASS | 9:47 | : | F,P | 1 |
| 42M | PASS | : | : | | 0 |
| 42M | PASS | : | : | | 0 |
| 42M | PASS | : | : | | 0 |
| 42M | PASS | : | : | | 0 |
| 42M | PASS | : | : | | 0 |
| 42FM | PASS | 4:55 | : | T,F | 1 |
| 42FM | PASS | : | : | | 0 |
| 42FM | PASS | : | : | | 0 |
| 42FM | PASS | : | : | | 0 |
| 42FM | PASS | : | : | | 0 |
| 42FM | PASS | 9:46 | : | F | 1 |
| 42FM | PASS | : | : | | 0 |
| 42FM | PASS | : | : | | 0 |
| 42FM | PASS | 7:42 | : | T,F | 1 |
| 42FM | PASS | : | : | | 0 |
| 43M | FAIL | 7:15 | 9:27 | F | 2 |
| 43M | FAIL | 1:05 | 4:45 | T | 2 |
| 43M | PASS | 8:51 | : | F,P | 1 |
| 43M | PASS | : | : | | 0 |
| 43M | PASS | 4:37 | : | F,P | 1 |
| 43M | PASS | : | : | | 0 |
| 43M | PASS | : | : | | 0 |
| 43M | PASS | : | : | | 0 |
| 43M | PASS | : | : | | 0 |
| 43M | PASS | : | : | | 0 |
| 43FM | PASS | : | : | | 0 |
| 43FM | PASS | : | : | | 0 |
| 43FM | PASS | : | : | | 0 |
| 43FM | PASS | : | : | | 0 |
| 43FM | PASS | 6:53 | : | F,P | 1 |
| 43FM | PASS | 9:48 | : | F | 1 |
| 43FM | PASS | : | : | | 0 |
| 43FM | PASS | : | : | | 0 |
| 43FM | PASS | : | : | | 0 |
| 43FM | PASS | : | : | | 0 |
| 44M | PASS | : | : | | 0 |
| 44M | PASS | 6:00 | : | F | 1 |
| 44M | PASS | : | : | | 0 |
| 44M | PASS | 8:57 | : | F,P | 1 |
| 44M | PASS | : | : | | 0 |
| 44M | PASS | : | : | | 0 |
| 44M | PASS | : | : | | 0 |
| 44M | PASS | : | : | | 0 |
| 44M | PASS | : | : | | 0 |
| 44M | PASS | 9:00 | : | F,P | 1 |
| 44FM | FAIL | 3:52 | 5:21 | F,P | 2 |
| 44FM | PASS | : | : | | 0 |
| 44FM | PASS | : | : | | 0 |
| 44FM | PASS | : | : | | 0 |
| 44FM | PASS | : | : | | 0 |
| 44FM | PASS | : | : | | 0 |
| 44FM | PASS | : | : | | 0 |
| 44FM | PASS | : | : | | 0 |
| 44FM | PASS | : | : | | 0 |
| 44FM | PASS | : | : | | 0 |
| 45M | FAIL | 7:03 | 7:21 | F,P | 3 |
| 45M | FAIL | 6:36 | 7:52 | F,P | 2 |
| 45M | PASS | : | : | | 0 |
| 45M | PASS | : | : | | 0 |
| 45M | PASS | : | : | | 0 |
| 45M | PASS | : | : | | 0 |
| 45M | PASS | : | : | | 0 |
| 45M | PASS | : | : | | 0 |

TABLE III-continued (Children)

| AGE/ SEX (Mos) | PASS OR FAIL | TIME TO OPEN FIRST UNIT | MODE TIME OF FAILURE | UNITS OF OPENING | OPEN-ED |
|---|---|---|---|---|---|
| 45M | PASS | 9:20 | : | F,P,T | 1 |
| 45M | PASS | : | : | | 0 |
| 45FM | FAIL | 4:57 | 6:41 | F,P | 2 |
| 45FM | PASS | 4:34 | : | T,F | 1 |
| 45FM | PASS | : | : | | 0 |
| 45FM | PASS | : | : | | 0 |
| 45FM | PASS | 4:47 | : | F | 1 |
| 45FM | PASS | 6:10 | : | T | 1 |
| 45FM | PASS | : | : | | 0 |
| 45FM | PASS | : | : | | 0 |
| 45FM | PASS | : | : | | 0 |
| 45FM | PASS | : | : | | 0 |
| 46M | FAIL | 6:12 | 7:06 | T | 5 |
| 46M | FAIL | 4:58 | 6:40 | T,F | 2 |
| 46M | PASS | : | : | | 0 |
| 46M | PASS | 5:17 | : | F,P | 1 |
| 46M | PASS | 5:33 | : | F,P | 1 |
| 46M | PASS | : | : | | 0 |
| 46M | PASS | : | : | | 0 |
| 46M | PASS | : | : | | 0 |
| 46M | PASS | : | : | | 0 |
| 46M | PASS | 7:56 | : | F,P | 1 |
| 46FM | FAIL | 4:40 | 6:30 | F,P | 2 |
| 46FM | PASS | : | : | | 0 |
| 46FM | PASS | : | : | | 0 |
| 46FM | PASS | : | : | | 0 |
| 46FM | PASS | : | : | | 0 |
| 46FM | PASS | 8:05 | : | F,P | 1 |
| 46FM | PASS | : | : | | 0 |
| 46FM | PASS | : | : | | 0 |
| 46FM | PASS | : | : | | 0 |
| 46FM | PASS | 3:18 | : | F | 1 |
| 47M | FAIL | 1:49 | 7:40 | F,P | 2 |
| 47M | PASS | : | : | | 0 |
| 47M | PASS | : | : | | 0 |
| 47M | PASS | : | : | | 0 |
| 47M | PASS | : | : | | 0 |
| 47M | PASS | 3:56 | : | F,P | 1 |
| 47M | PASS | : | : | | 0 |
| 47M | PASS | : | : | | 0 |
| 47M | PASS | : | : | | 0 |
| 47M | PASS | : | : | | 0 |
| 47FM | PASS | : | : | | 0 |
| 47FM | PASS | : | : | | 0 |
| 47FM | PASS | : | : | | 0 |
| 47FM | PASS | 8:15 | : | F,P | 1 |
| 47FM | PASS | : | : | | 0 |
| 47FM | PASS | : | : | | 0 |
| 47FM | PASS | 8:27 | : | F,P | 1 |
| 47FM | PASS | : | : | | 0 |
| 47FM | PASS | : | : | | 0 |
| 47FM | PASS | : | : | | 0 |
| 48M | FAIL | 2:45 | 3:33 | T,F | 7 |
| 48M | FAIL | 2:04 | 3:47 | F,P | 2 |
| 48M | PASS | : | : | | 0 |
| 48M | PASS | 6:48 | : | F,P | 1 |
| 48M | PASS | : | : | | 0 |
| 48M | PASS | : | : | | 0 |
| 48M | PASS | : | : | | 0 |
| 48M | PASS | : | : | | 0 |
| 48M | PASS | : | : | | 0 |
| 48M | PASS | : | : | | 0 |
| 48FM | PASS | : | : | | 0 |
| 48FM | PASS | 6:26 | : | F,P | 1 |
| 48FM | PASS | : | : | | 0 |
| 48FM | PASS | : | : | | 0 |
| 48FM | PASS | : | : | | 0 |
| 48FM | PASS | 9:29 | : | F,P | 1 |
| 48FM | PASS | : | : | | 0 |
| 48FM | PASS | : | : | | 0 |
| 48FM | PASS | : | : | | 0 |
| 48FM | PASS | 4:03 | : | F,P | 1 |
| 49M | FAIL | 7:47 | 9:48 | F,P | 2 |
| 49M | FAIL | 3:45 | 4:42 | CH,F | 2 |
| 49M | FAIL | 2:26 | 5:39 | F,P | 2 |
| 49M | PASS | 7:04 | : | F,P | 1 |

TABLE III-continued (Children)

| AGE/ SEX (Mos) | PASS OR FAIL | TIME TO OPEN FIRST UNIT | MODE TIME OF FAILURE | UNITS OF OPENING | OPEN-ED |
|---|---|---|---|---|---|
| 49M | PASS | : | : | | 0 |
| 49M | PASS | : | : | | 0 |
| 49M | PASS | : | : | | 0 |
| 49M | PASS | : | : | | 0 |
| 49M | PASS | : | : | | 0 |
| 49M | PASS | : | : | | 0 |
| 49FM | FAIL | 6:36 | 8:37 | F | 4 |
| 49FM | FAIL | 4:00 | 7:55 | T,F | 3 |
| 49FM | PASS | : | : | | 0 |
| 49FM | PASS | : | : | | 0 |
| 49FM | PASS | : | : | | 0 |
| 49FM | PASS | : | : | | 0 |
| 49FM | PASS | : | : | | 0 |
| 49FM | PASS | : | : | | 0 |
| 49FM | PASS | : | : | | 0 |
| 49FM | PASS | : | : | | 0 |
| 50M | FAIL | 7:28 | 9:34 | F,P | 2 |
| 50M | FAIL | 6:20 | 7:10 | F,P | 2 |
| 50M | PASS | : | : | | 0 |
| 50M | PASS | 7:51 | : | F,P | 1 |
| 50M | PASS | 8:47 | : | F,P | 1 |
| 50M | PASS | : | : | | 0 |
| 50M | PASS | 8:44 | : | F,P | 1 |
| 50M | PASS | : | : | | 0 |
| 50M | PASS | 6:55 | : | F | 1 |
| 50M | PASS | : | : | | 0 |
| 50FM | FAIL | 5:48 | 7:07 | F,P | 2 |
| 50FM | FAIL | 6:06 | 9:05 | F,P | 2 |
| 50FM | FAIL | 6:30 | 9:18 | F,P | 2 |
| 50FM | PASS | : | : | | 0 |
| 50FM | PASS | : | : | | 0 |
| 50FM | PASS | 8:40 | : | T,F | 1 |
| 50FM | PASS | 6:49 | : | F,P | 1 |
| 50FM | PASS | : | : | | 0 |
| 50FM | PASS | : | : | | 0 |
| 51M | FAIL | 1:15 | 3:50 | F | 2 |
| 51M | FAIL | 3:29 | 6:22 | F,P | 3 |
| 51M | FAIL | 5:00 | 6:15 | F | 3 |
| 51M | PASS | 3:52 | : | F | 1 |
| 51M | PASS | 7:15 | : | F | 1 |
| 51M | PASS | : | : | | 0 |
| 51M | PASS | : | : | | 0 |
| 51M | PASS | : | : | | 0 |
| 51M | PASS | : | : | | 0 |
| 51M | PASS | : | : | | 0 |
| 51FM | FAIL | 2:15 | 2:58 | F,P | 4 |
| 51FM | FAIL | 3:22 | 4:33 | F,P | S |
| 51FM | FAIL | 7:56 | 8:04 | F,P | 2 |
| 51FM | FAIL | 1:55 | 3:09 | T | 7 |
| 51FM | PASS | : | : | | 0 |
| 51FM | PASS | : | : | | 0 |
| 51FM | PASS | 8:30 | : | T,F | 1 |
| 51FM | PASS | : | : | | 0 |
| 51FM | PASS | : | : | | 0 |
| 51FM | PASS | : | : | | 0 |

TABLE IV (Adults)

| AGE (YEAR) | SEX | TIME TO OPEN | PASS OR FAIL |
|---|---|---|---|
| 26 | M | :20 | PASS |
| 18 | M | 1:12 | PASS |
| 31 | M | :32 | PASS |
| 24 | M | :25 | PASS |
| 25 | M | :39 | PASS |
| 45 | M | :47 | PASS |
| 32 | M | :32 | PASS |
| 23 | M | :42 | PASS |
| 33 | M | :37 | PASS |
| 39 | M | :17 | PASS |
| 29 | M | :18 | PASS |
| 30 | M | 1:27 | PASS |
| 30 | M | :23 | PASS |
| 23 | M | 1:06 | PASS |

TABLE IV-continued

| AGE (YEAR) | SEX | (Adults) TIME TO OPEN | PASS OR FAIL |
|---|---|---|---|
| 23 | M | 1:30 | PASS |
| 18 | M | :30 | PASS |
| 34 | M | :27 | PASS |
| 44 | M | :22 | PASS |
| 41 | M | :14 | PASS |
| 25 | M | :34 | PASS |
| 36 | M | :23 | PASS |
| 28 | M | :31 | PASS |
| 31 | M | :22 | PASS |
| 33 | M | :19 | PASS |
| 31 | M | :10 | PASS |
| 45 | M | :31 | PASS |
| 37 | M | :30 | PASS |
| 18 | M | :27 | PASS |
| 18 | M | :20 | PASS |
| 18 | M | 1:10 | PASS |
| 18 | FM | 1:40 | PASS |
| 18 | FM | 1:04 | PASS |
| 22 | FM | :56 | PASS |
| 19 | FM | 1:10 | PASS |
| 39 | FM | :10 | PASS |
| 34 | FM | :21 | PASS |
| 38 | FM | 1:09 | PASS |
| 21 | FM | :42 | PASS |
| 31 | FM | :23 | PASS |
| 18 | FM | 1:00 | PASS |
| 22 | FM | 1:04 | PASS |
| 32 | FM | :43 | PASS |
| 29 | FM | :11 | PASS |
| 44 | FM | :12 | PASS |
| 41 | FM | :20 | PASS |
| 35 | FM | 1:15 | PASS |
| 40 | FM | :45 | PASS |
| 33 | FM | :42 | PASS |
| 36 | FM | :42 | PASS |
| 26 | FM | :43 | PASS |
| 31 | FM | :32 | PASS |
| 40 | FM | :32 | PASS |
| 27 | FM | :27 | PASS |
| 23 | FM | :32 | PASS |
| 27 | FB | :34 | PASS |
| 29 | FM | :17 | PASS |
| 18 | FM | 1:15 | PASS |
| 40 | FM | :34 | PASS |
| 37 | FM | :22 | PASS |
| 19 | FM | 1:04 | PASS |
| 18 | FM | :28 | PASS |
| 30 | FM | :19 | PASS |
| 29 | FM | :31 | PASS |
| 28 | FM | :37 | PASS |
| 18 | FM | :19 | PASS |
| 18 | FM | 2:47 | PASS |
| 20 | FM | :23 | PASS |
| 22 | FM | :34 | PASS |
| 33 | FM | :09 | PASS |
| 23 | FM | :41 | PASS |
| 30 | FM | :37 | PASS |
| 28 | FM | :39 | PASS |
| 35 | FM | :21 | PASS |
| 29 | FM | :42 | PASS |
| 18 | FM | 1:12 | PASS |
| 28 | FM | :59 | PASS |
| 41 | FM | :58 | PASS |
| 25 | FM | :59 | PASS |
| 37 | FM | :15 | PASS |
| 33 | FM | :42 | PASS |
| 19 | FM | 1:39 | PASS |
| 23 | FM | :42 | PASS |
| 40 | FM | :22 | PASS |
| 39 | FM | 1:23 | PASS |
| 18 | FM | :24 | PASS |
| 36 | FM | :18 | PASS |
| 31 | FM | :37 | PASS |
| 39 | FM | :44 | PASS |
| 24 | FM | :54 | PASS |
| 31 | FM | :17 | PASS |
| 26 | FM | :27 | PASS |
| 33 | FM | :56 | PASS |

TABLE IV-continued

| AGE (YEAR) | SEX | (Adults) TIME TO OPEN | PASS OR FAIL |
|---|---|---|---|
| 18 | FM | :37 | PASS |
| 21 | FM | :23 | PASS |
| 26 | FM | :38 | PASS |
| 23 | FM | 2:04 | PASS |
| 19 | FM | :37 | PASS |
| 38 | FM | :31 | PASS |
| 34 | FM | :41 | PASS |
| 45 | FM | :27 | PASS |

Although two particular embodiments of the blister package of the invention have been shown and described herein, those of ordinary skill in the art will recognize numerous modifications and substitutions of that which has been described herein which may be made therein, as by adding, combining, or subdividing parts or steps, or substituting equivalents, while retaining significant advantages and benefits of the blister package of the invention, which itself is defined in the following claims. It is intended, therefore, that all of these modifications and variations be within the scope of the present invention as described and claimed herein, and that the invention be limited only by the scope of the claims which follow, and that such claims be interpreted as broadly as is reasonable.

We claim:

1. A tamper-evident, child-resistant blister package for medicaments and nonmedicaments comprising:

(a) a top layer;

(b) a nonrupturable film layer attached to an inner surface of said top layer;

(c) a rupturable film layer attached to that side of said nonrupturable film layer which is not attached to said top layer;

(d) a blister sheet attached to that side of said rupturable film layer which is not attached to said nonrupturable film layer, said blister sheet containing one or more article-receiving pockets which are not separable from said blister package;

(e) perforation means located adjacent to each article-receiving pocket and extending through each of said top layer, said nonrupturable film layer, said rupturable film layer and said blister sheet, said perforation means, when punctured, commencing the opening of said blister package, and generating one or more pull tabs which extend towards and across their adjacent article-receiving pocket, but not across other article-receiving pockets;

(f) one or more depressions present in said blister sheet proximately located to said perforation means, in which said rupturable film layer is not adhered to said blister sheet; and (g) at least one stop means located between each perforation means and its adjacent article-receiving pocket, and extending through each of said top layer, said nonrupturable film layer, said rupturable film layer and said blister sheet, for selectively separating said nonrupturable film layer from said rupturable film layer and exposing said rupturable film layer extending over said article-receiving pocket when said nonrupturable film layer is directionally pulled across said article-receiving pocket so that the contents of said article-receiving pocket can be pushed through said rupturable film layer, with said blister package remaining intact at each of its outer edges.

2. The blister package of claim 1 which additionally comprises one or more support ridges.

3. The blister package of claim 1 which additionally comprises one or more nonrupturable film layer dividers in said blister sheet located between adjacent article-receiving pockets.

4. The blister package of claim 3 which additionally comprises one or more support ridges.

5. The blister package of claims 1 wherein said top layer is paper or a printable film.

6. The blister package of claim 5 wherein the basis weight of said top layer ranges from about 20 to about 30 pounds per ream.

7. The blister package of claim 6 wherein said nonrupturable film layer is a polyester, polyolefin, polyamide, polycarbonate or polysulfone film, or a combination thereof.

8. The blister package of claim 7 wherein the thickness of said nonrupturable film layer ranges from about 0.5 to about 4 mm.

9. The blister package of claim 8 wherein said rupturable film layer is paper, plastic or foil.

10. The blister package of claim 9 wherein the thickness of said rupturable film layer ranges from about 0.00035 to about 0.03 inches.

11. The blister package of claim 10 wherein said blister sheet is polyvinyl chloride, polystyrene, nylon, polyethylene, polypropylene or polyethylene terephthalate.

12. The blister package of claim 11 wherein the thickness of said blister sheet ranges from about 7.5 to about 30 mm.

13. The blister package of claim 12 wherein said perforation means is a plurality of perforations.

14. The blister package of claim 13 wherein said stop means is a die cut.

15. The blister package of claim 14 wherein said top layer is attached to said nonrupturable film layer by a first adhesive layer.

16. The blister package of claim 15 wherein said nonrupturable film layer is attached to said rupturable film layer by a pressure sensitive adhesive layer.

17. The blister package of claim 16 wherein said rupturable film layer is attached to said blister sheet by a heat seal coating.

18. The blister package of claim 17 wherein said top layer is calendared bleach paper.

19. The blister package of claim 18 wherein said nonrupturable film layer is 48 gauge polyester.

20. The blister package of claim 19 wherein said rupturable film layer is aluminum foil.

21. The blister package of claim 20 wherein said blister sheet is polyvinyl chloride.

22. The blister package of claim 21 wherein the thickness of said nonrupturable film layer is about 0.75 mm.

23. The blister package of claim 22 wherein the thickness of said rupturable film layer is about 0.001 inch.

24. The blister package of claim 23 wherein the thickness of said blister sheet is about 15 mm.

25. The blister package of claim 24 wherein said first adhesive layer is polyethylene, polyester, vinyl, acrylic or urethane thermoset, said pressure sensitive adhesive layer is rubber, vinyl or an acrylic cement, and said heat seal coating is a vinyl, an acrylic, a polyolefin or an ionomer resin.

26. The blister package of claim 25 wherein said first adhesive layer is a urethane thermoset applied in an amount ranging from about 2.0 to about 1.4 pounds per ream, said pressure sensitive adhesive layer is thermoplastic rubber applied in an amount ranging from about 0.75 to about 1.25 pounds per ream and said heat seal coating is acrylic-modified vinyl applied in an amount ranging from about 2.4 to about 3.6 pounds per ream.

27. The blister package of claim 26 wherein said perforations form the shape of a "T" or a right angle.

28. The blister package of claim 27 wherein said perforations are located between each of two of said article-receiving pockets of a set of two article-receiving pockets, or to the side of any one article-receiving pocket.

29. The blister package of claim 28 wherein each depression is triangular shaped.

* * * * *

UNITED STATES PATENT AND TRADEMARK OFFICE

CERTIFICATE OF CORRECTION

PATENT NO. : 5,310,060

DATED : May 10, 1994

INVENTOR(S) : Bitner, et al.

It is certified that error appears in the above-identified patent and that said Letters Patent is hereby corrected as shown below:

Column 3, line 31, reading "packages o" should read -- packages of --.

At Column 21, line 9, Column 22, line 4, Column 23, line 4, Column 26, line 12 and Column 28, line 4, at each occurrence, the headings of the last three columns reading "MODE TIME OF FAILURE", "UNITS OF OPENING" and "OPENED" should read -- TIME OF FAILURE --, -- MODE OF OPENING -- and -- UNITS OPENED --.

Column 21, line 18, another entry under each of the six headings should read, -- 42M PASS : : (blank under column 5) 0 --.

Column 22, line 29, another entry under each of the six headings should read, -- 46FM PASS : : (blank under column 5) 0 --.

Column 24, line 31, reading "48" should read -- 45 --.

Column 24, line 49, reading "38" should read -- 35 --.

Column 24, line 50, reading "36" should read -- 35 --.

UNITED STATES PATENT AND TRADEMARK OFFICE

CERTIFICATE OF CORRECTION

PATENT NO. : 5,310,060 Page 2 of 2

DATED : May 10, 1994

INVENTOR(S) : Bitner, et al.

It is certified that error appears in the above-identified patent and that said Letters Patent is hereby corrected as shown below:

Column 28, line 35, another entry under each of the six headings should read, -- 50FM PASS : : (blank under column 5) 0 --.

Column 28, line 44, reading "S" should read -- 5 --.

Column 31, line 11, reading "Claims 1" should read -- Claim 1 --.

Signed and Sealed this

Tenth Day of October, 1995

Bruce Lehman

*Attest:*

BRUCE LEHMAN

*Attesting Officer*

*Commissioner of Patents and Trademarks*